US006109060A

United States Patent [19]

Shimomae et al.

[11] Patent Number: 6,109,060

[45] Date of Patent: Aug. 29, 2000

[54] AIR-COOLED ABSORPTION TYPE REFRIGERATING APPARATUS

[75] Inventors: Hiroki Shimomae; Masato Utsumi; Katsuhiro Kawabata; Noriyuki Okuda; Koichi Yasuo; Fumiaki Yakushiji; Kazuki Takeuchi, all of Osaka, Japan

[73] Assignee: Daikin Industries, Ltd., Osaka, Japan

[21] Appl. No.: 09/180,870

[22] PCT Filed: Mar. 17, 1998

[86] PCT No.: PCT/JP98/01118

§ 371 Date: Nov. 24, 1998

§ 102(e) Date: Nov. 24, 1998

[87] PCT Pub. No.: WO98/44302

PCT Pub. Date: Oct. 8, 1998

[30] Foreign Application Priority Data

Mar. 27, 1997 [JP] Japan ..... 9-075889

[51] Int. Cl.[7] ..... F25B 15/00

[52] U.S. Cl. ..... 62/476; 62/485

[58] Field of Search ..... 62/476, 485

[56] References Cited

U.S. PATENT DOCUMENTS

| | | | |
|---|---|---|---|
| 3,363,674 | 1/1968 | Peckham et al. . | |
| 3,626,716 | 12/1971 | Leonard | 62/476 |
| 3,964,273 | 6/1976 | Merrick . | |
| 4,941,329 | 7/1990 | Imura et al. . | |
| 5,383,341 | 1/1995 | Zur et al. | 62/476 |

FOREIGN PATENT DOCUMENTS

| | | |
|---|---|---|
| 45-7910 | 3/1970 | Japan . |
| 51-106259 | 9/1976 | Japan . |
| 64-84058 | 3/1989 | Japan . |
| 63-34162 | 8/1989 | Japan . |
| 1-225868 | 9/1989 | Japan . |
| 64-9562 | 7/1990 | Japan . |
| 10-54622 | 2/1998 | Japan . |

*Primary Examiner*—William Doerrler
*Assistant Examiner*—Melvin Jones
*Attorney, Agent, or Firm*—Birch, Stewart, Kolasch & Birch, LLP

[57] ABSTRACT

An air inlet 16 is formed in a rear surface side vertical wall section 10*b*, or a single surface of an apparatus main body 10, and an air stream path that extends from the air inlet 16 of the rear surface side vertical wall section 10*b* to air outlets 14*a* and 14*b* formed upwardly aslant in an inclined surface section 13 that is also the single surface provided in the opposite direction. In this air stream path are arranged an air-cooling absorber 17, an air-cooling condenser 19 and fans 15*a* and 15*b* provided with their fan axes arranged upwardly aslant in correspondence with the air outlets 14*a* and 14*b*. With this arrangement, the air-cooling absorption type refrigerating apparatus is made to have an integrated air intake space and a reduced installation area, and an air stream path extending from the air inlet to the air outlets is made to have a reduced draft loss to allow the flow velocity distribution of the air stream of the heat exchange section to be uniformed.

14 Claims, 21 Drawing Sheets

AIR-COOLED ABSORPTION TYPE REFRIGERATING APPARATUS

This application is the national phase under 35 U.S.C. §371 of prior PCT International Application No. PCT/JP98/01118 which has an International filing date of Mar. 17, 1998 which designated the United States of America.

TECHNICAL FIELD

The present invention relates to an air-cooled absorption type refrigerating apparatus.

BACKGROUND ART

For example, as shown in FIG. 35 through FIG. 38, the prior art air-cooled absorption type refrigerating apparatus is constructed by providing a fan 2 in a center portion of a roughly cubic apparatus main body (main body housing) 1, forming air inlets 3*a* through 3*c* on three side walls of the body, providing air-cooled absorbers 4*a* and 4*b* and an air-cooled condenser 5 inside the inlets and providing evaporators 6 and 6 above the air-cooled absorbers 4*a* and 4*b*.

Then, the air taken in from the air inlets 3*a* through 3*c* by the fan 2 is made to pass through the air-cooled absorbers 4*a* and 4*b* for the cooling of an absorbent fluid and thereafter blown out upwardly from an air outlet 7 provided on the upper side of the apparatus main body 1 while being changed in direction (refer to. for example, the prior art reference of Japanese Patent Laid-Open Publication No. HEI 1-225868 as a known similar example).

However, the above prior art construction has the following problems.

(1) Since the air intake surfaces are formed in three surface directions of the apparatus main body, there are necessitated air intake spaces outside these three surface directions. As indicated by an imaginary line in FIG. 36, there is necessitated a wide installation space S expanded in four surface directions $S_2$, $S_3$ and $S_4$ including a working space $S_1$ for maintenance service in addition to the occupation area of the apparatus main body 1 itself.

(2) Since the air stream path extending from the air inlets to the air outlet varies perpendicularly from the horizontal direction to the vertical direction, as shown in FIG. 39, there is a nonuniformity in the flow velocity distribution of the air stream passing through the heat exchangers of the air-cooled absorbers and the air-cooled condenser. This leads to a reduction in the heat exchange performances of the heat exchangers and an increase in draft loss, causing the generation of noises.

SUMMARY AND OBJECTS OF THE INVENTION

The object of the present invention is to provide an air-cooled absorption type refrigerating apparatus capable of solving the aforementioned problems.

In order to achieve the above object, the air-cooled absorption type refrigerating apparatus of the present invention is characterized in that an air inlet is formed in a single surface of an apparatus main body, an air stream path that extends from the air inlet of the single surface to an air outlet that is formed also in a single surface provided in the opposite direction is formed and an air-cooled absorber and an air-cooled condenser are arranged in the air stream path.

Therefore, the air stream path has a form which smoothly continues from the air inlet to the air outlet without perpendicularity, so that the draft loss is reduced to uniform the flow velocity distribution of the air streams of the heat exchangers of the air-cooled absorber and the air-cooled condenser, thereby improving the heat exchange performance and reducing the noises. Then, as compared with the prior art construction in which a plurality of surfaces in different directions of the apparatus main body must be each provided with an air inlet, the present apparatus main body can be formed compact, or in small size. In addition, it is sufficient to provide a relatively small installation space including the air intake space corresponding to the single air inlet surface and the working space necessary for maintenance service, so that the installation space of the apparatus main body can be reduced.

In an embodiment of the present invention, the air outlet is arranged upwardly aslant, and a fan is provided with its fan axis arranged upwardly aslant in correspondence with the air outlet.

Accordingly, with this construction, the stream of air to be blown outward is directed upward, and the installation area on the frontward side can further be reduced.

In an embodiment of the present invention, the air outlet is arranged parallel to the air inlet, and the fan is provided with its fan axis arranged in a direction of wind blown out of the air outlet.

Accordingly, with this construction, the flow velocity distribution of the air streams of the air-cooled absorber and the air-cooled condenser become more uniform, thereby improving the heat exchange performance and reducing noises.

In an embodiment of the present invention, the air-cooled condenser is provided in a downstream side lower position of the air-cooled absorber in the air stream path.

In the above air-cooled absorber, an absorbing effect gradually progresses with the flow of the absorbent fluid from the upper side to the lower side, and the absorbent on the lower side is in a state that the absorbing effect is roughly completed. Therefore, if the air-cooled condenser is provided on the downstream side in positional correspondence with the lower portion of the air-cooled absorber, then the temperature of air taken into the air-cooled condenser does not increase so much even on the downstream side of the air-cooled absorber, so that less influence is exerted on the condensation performance.

Furthermore, since the air-cooled condenser is provided on the downstream side of the air stream of the air-cooled absorber, the air-cooled absorber does not take in the air of which the temperature is increased through heat exchange with the air-cooled condenser. Therefore, the absorption performance of the air-cooled absorber is not reduced. Consequently, the main body of the absorption type refrigerating apparatus can be compacted, contributing to the cost reduction of the apparatus.

As a result, according to the air-cooled absorption type refrigerating apparatus of the present invention, there can be provided a low-cost air-cooled absorption type refrigerating apparatus of which the apparatus main body is compact and the installation area of the apparatus is small. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
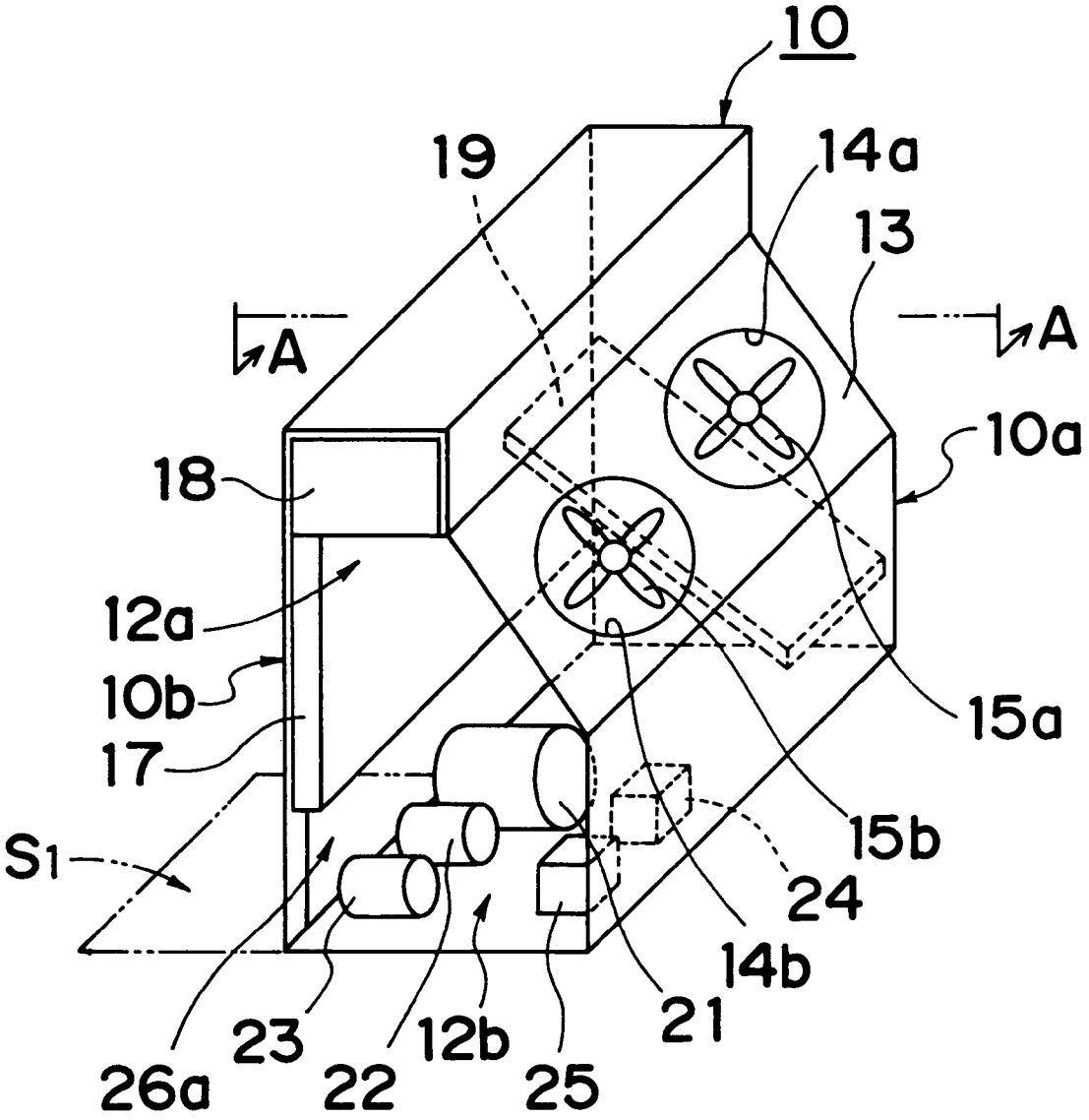
FIG. 1 is a partially cutaway perspective view of an air-cooled absorption type refrigerating apparatus according to a first embodiment of the present invention.

BEST MODE FOR CARRYING OUT THE INVENTION (First Embodiment)

FIG. 1 through FIG. 5 show the construction of an air-cooling absorption type refrigerating apparatus according to a first embodiment of the present invention.

In the figures, first, the reference numeral 10 denotes the apparatus main body (main body housing) of this air-cooled absorption type refrigerating apparatus. As shown in, for example, FIG. 1, this apparatus main body 10 has a compact shape that is thin in the depthwise direction and elongated sidewise as a whole. A middle portion of the front surface side vertical wall section 10*a* is downwardly inclined in a trapezoidal surface form, so that the main body is formed into a structure in which a downside inner space 12*b* is a specified width wider in the depthwise direction than an upside inner space 12*a*.

Then, a lateral pair of first and second circular air outlets 14*a* and 14*b* are formed at a specified interval while being positioned at the center of a slant surface section 13 formed by the trapezoidally inclined section, and a lateral pair of first and second fans (propeller fans) 15*a* and 15*b* are rotatably provided for blowing air outwardly while being positioned inside them (the fan guides).

On the other hand, in the rear surface side vertical wall section 10*b* of the apparatus main body 10 is formed a rectangular air inlet 16 that expands in the vertical and horizontal directions roughly throughout the entire region of the wall, thereby forming a roughly straight air stream path extending from this air inlet 16 to the first and second air outlets 14*a* and 14*b*. Then, inside the air inlet 16 is provided upright an air-cooled absorber 17 having a flat structure of a size almost as large as that of the rear surface side vertical wall section 10*b*, leaving on the lower side an installation space for a solution pump 23 and so on and an opening 26*a* for service use as described later. Further, above this air-cooling absorber 17 is provided an evaporator 18 that extends throughout the entire width to both the right-hand and left-hand sides using the upside inner space 12*a* of a narrow depth.

On the lower side of the air-cooled absorber 17 in the air stream path comprised of a single pathway formed roughly straightly from the rear surface side to the front surface side as described above is provided an air-cooled condenser 19 that is positioned on the air discharge side (on the downstream side of the air stream) and has a lateral width reduced to approximately one half of that of the air-cooled absorber 17, similarly to the air-cooling absorber 17, in a state in which it leans toward the air-cooled absorber 17 side from the rear side of the front surface side vertical wall section 10*a* leaving on the lower side an installation space for a refrigerator pump 22 and so on.

At the bottom portion of the downside inner space 12*b* inside the apparatus main body 10 are further provided a high-temperature regenerator 21, a refrigerator pump 22 for supplying condensed water from the air-cooling condenser to the evaporator 18, a solution pump 23, and other necessary units 24 and 25.

Figure 2:
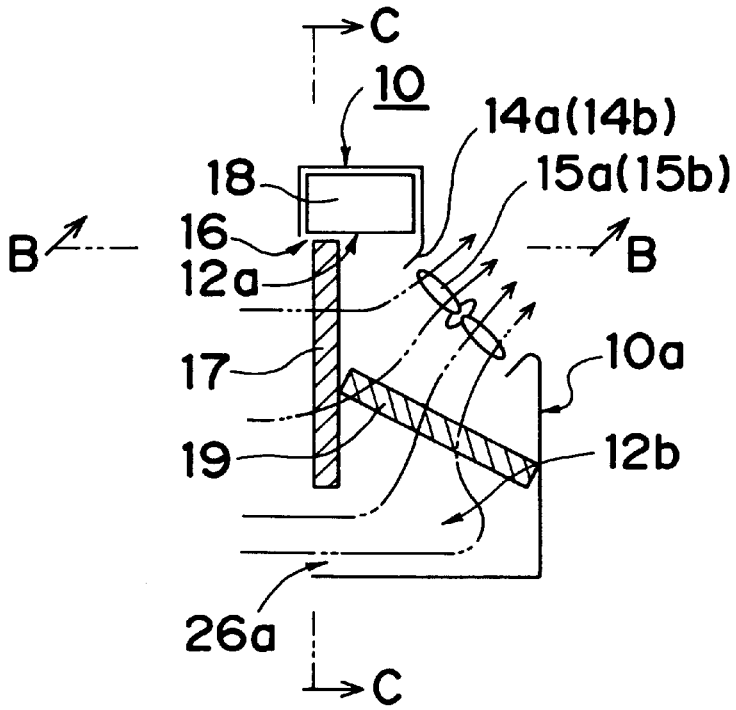
FIG. 2 is a sectional view of the above refrigerating apparatus along the line A—A in FIG. 1.

Therefore, according to the above construction, if the first and second fans 15*a* and 15*b* are driven, then the air taken in from the air inlet 16 except the service opening 26*a* passes firstly from the air-cooling absorber 17 through the air-cooled condenser 19 and the air taken in from the service opening 26*a* passes through the air-cooled condenser 19 to uniformly flow through the roughly straight air stream path as indicated by the arrows in FIG. 2 in the apparatus main body 10, and then smoothly blown out of the first and second air outlets 14*a* and 14*b* via the first and second fans 15*a* and 15*b*.

That is, according to the above construction, the inlets provided for the air-cooled absorber 17 and the air-cooled condenser 19 are commonly collectively formed in the rear surface side vertical wall section 10*b* of the single surface of the apparatus main body 10 so that the inlets can be concurrently used as the air inlet 16 and partially as the service opening 26*a*, thereby forming a roughly straight air stream path extending from the air inlet 16 of the single surface to the first and second air outlets 14*a* and 14*b* formed in the front surface side vertical wall section 10*a* that belongs to the apparatus main body 10 and is the similar single surface located in the opposite direction, with the air-cooled absorber 17 arranged on the upstream side of the air stream in this air stream path and with the air-cooled condenser 19 arranged aslant on the downstream side of the lower portion of the absorber Then, air flows uniformly through the heat exchange sections of the air-cooling absorber 17 and the air-cooled condenser 19.

Figure 3:
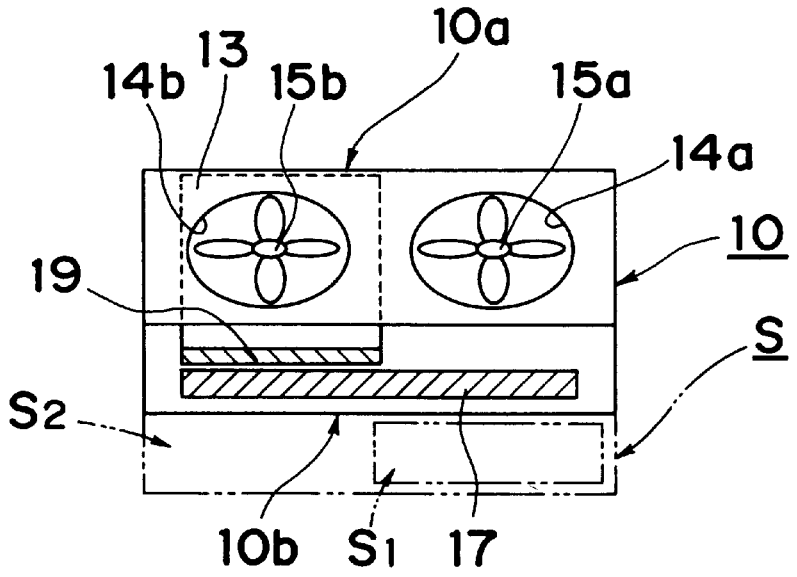
FIG. 3 is a sectional view of the above refrigerating apparatus along the line B—B in FIG. 2.
Figure 4:
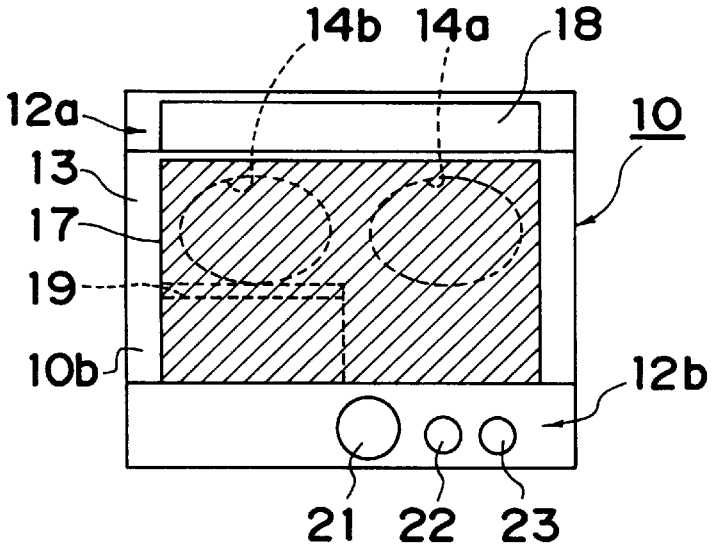
FIG. 4 is a sectional view of the above refrigerating apparatus along the line C—C in FIG. 2.

Therefore, the apparatus main body can be formed into a thin compact shape as compared with the construction in which a plurality of surfaces in the different directions (in the directions of the three surfaces) of the apparatus main body are each required to be provided with an air inlet as observed in the prior art, allowing the occupation area of the apparatus itself to be reduced. Furthermore, as shown in FIG. 3, the above arrangement allows the apparatus to be installed only with a relatively small space S ($S=S_1+S_2$) comprised of an air intake space $S_2$ corresponding to the single air inlet surface and a space $S_1$ necessary for the maintenance work on the lower right-hand side of the space. Furthermore, the space $S_1$ necessary for the maintenance work is included in the air intake space $S_2$ and is able to be commonly used, and therefore, substantially only the small space of the air intake space $S_2$ is required to be provided.

As a result, a plurality of apparatus main bodies 10 can be installed as connected together.

Furthermore, by virtue of the provision of the air-cooled condenser 19 located on the downstream side of the air stream of the air-cooled absorber 17, there is no possibility of the occurrence of a reduction in absorption performance as a consequence of an increase in temperature of the air taken into the air-cooled absorber 17 due to the heat exchange through the air-cooled condenser 19 as observed in the aforementioned prior art in which the air-cooled condenser 19 is provided on the upstream side of the air stream of the air-cooled absorber 17. As a result, the main body of the absorption type refrigerating apparatus can be compacted, contributing to the cost reduction of the apparatus.

In the construction described above, the air-cooled condenser 19 is positioned on the downstream side of the air stream, while in the air-cooled absorber 17, the absorbing operation gradually progresses as an absorbent fluid is made to flow from the upper side to the lower side, and the absorbing operation is roughly completed on the lower side. The air-cooled condenser 19 is thus arranged on the downstream side in positional correspondence with the lower portion of the air-cooled absorber 17 where the absorbing operation is roughly completed. Therefore, the temperature of the air taken into the air-cooled condenser 19 does not increase so much to be allowed to exert less influence on the condensation performance.

Figure 5:
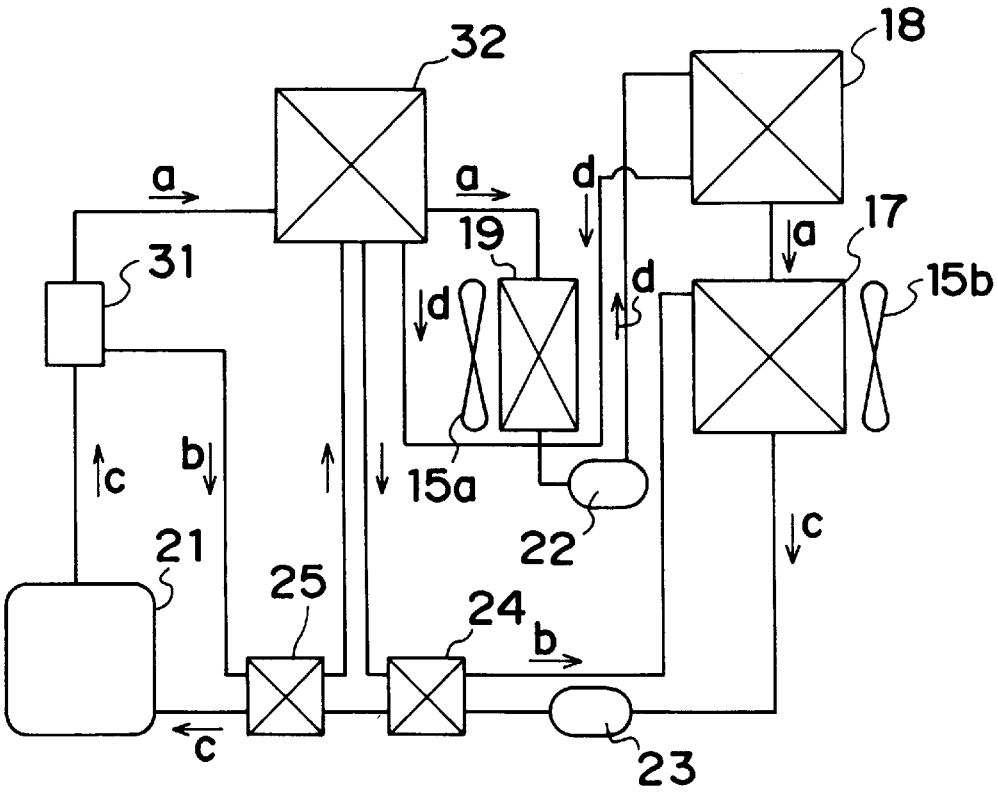
FIG. 5 is a refrigerating circuit diagram of the above refrigerating apparatus.

Next, the construction of a refrigerating circuit of the air-cooled (double effect type) absorption type refrigerating apparatus adopting the above construction is shown in FIG. 5.

In the air-cooled absorption type refrigerating apparatus shown in FIG. 5, the absorbent fluid is provided by, for example, lithium bromide aqueous solution (LiBr aqueous solution), while the refrigerant (fluid subjected to absorption) is provided by water vapor.

In FIG. 5, first, a high-temperature regenerator 21, is provided with a heat applying source such as a gas burner. Above this high-temperature regenerator 21 is provided a vapor-liquid separator 31 communicated via a liquid lift pipe. In the above high-temperature regenerator 21, a dilute lithium bromide solution "c" that has been used for absorption is heated and boiled to be supplied to the vapor-liquid separator 31 positioned upward via the liquid lift pipe, where the solution is regenerated by being separated into the water vapor "a" and an intermediate-concentration lithium bromide solution (intermediate-concentration absorbent fluid) "b".

The above dilute lithium bromide solution "c" is obtained by absorbing the water vapor "a" that serves as the refrigerant into the intermediate-concentration solution "b" that serves as the absorbent fluid in the air-cooled absorber 17 as described later, pre-heated via a low-temperature solution heat exchanger 24 and a high-temperature solution heat exchanger 25 and thereafter conveyed back to the high-temperature regenerator 21.

The water vapor "a" separated by the vapor-liquid separator 31 is conveyed to a low-temperature regenerator 32. During a cooling operation, the intermediate-concentration lithium bromide solution "b" exchanges heat with the dilute lithium bromide solution "c" in the high-temperature solution heat exchanger 25 and is then supplied to the low-temperature regenerator 32.

In the low-temperature regenerator 32 during the cooling operation, the water vapor "a" supplied from the vapor-liquid separator 31 and the intermediate-concentration lithium bromide solution "b" are made to exchange heat with each other, thereby condensing the water vapor "a" and evaporating the remaining moisture contained in the intermediate-concentration lithium bromide solution "b" for the extraction of a lithium bromide solution of a higher concentration.

The water vapor "a" evaporated from the intermediate-concentration lithium bromide solution "b" in the low-temperature regenerator 32 is conveyed to the air-cooled condenser 19 and condensed into the liquid of condensed water "d" and then supplied by the refrigerator pump 22 to the evaporator 18 together with the condensed water "d" condensed in the low-temperature regenerator 32. The concentrated lithium bromide solution "b" taken out of the low-temperature regenerator 32 exchanges heat with the dilute lithium bromide solution "c" in the low-temperature solution heat exchanger 24 as described above and thereafter supplied to the air-cooled absorber 17. The evaporator 18 is to make a refrigerant (for example, R407C) circulating through a secondary refrigerant cycle including the heat exchanger on the heat use side and the condensed water "d" conveyed from the air-cooled condenser 19 exchange heat with each other, serving as a cool heat source during the cooling operation.

Then, the dilute lithium bromide solution "c" taken out of the air-cooling absorber 17 is conveyed back to the high-temperature regenerator 21 via the low-temperature solution heat exchanger 24 and the high-temperature solution heat exchanger 25 by a refrigerant pump 23 as described above.

The air-cooling absorber 17 is constructed, for example, of a plurality of heat absorbing and transmitting pipes through which the absorbent fluid "b" vertically flows, radiating fins provided on the peripheral portions of this heat absorbing and transmitting pipes and an absorbent fluid distributing vessel that is provided above the heat absorbing and transmitting pipes and distributes the absorbent fluid "b" downwardly through the heat absorbing and transmitting pipes. Then, inside the absorbent fluid distributing vessel are provided the evaporator 18 and a spray unit for supplying the refrigerant (condensed water) "d" to the peripheral portion of an evaporation use heat transmitting pipe of the evaporator 18.

(Second Embodiment)

Figure 6:
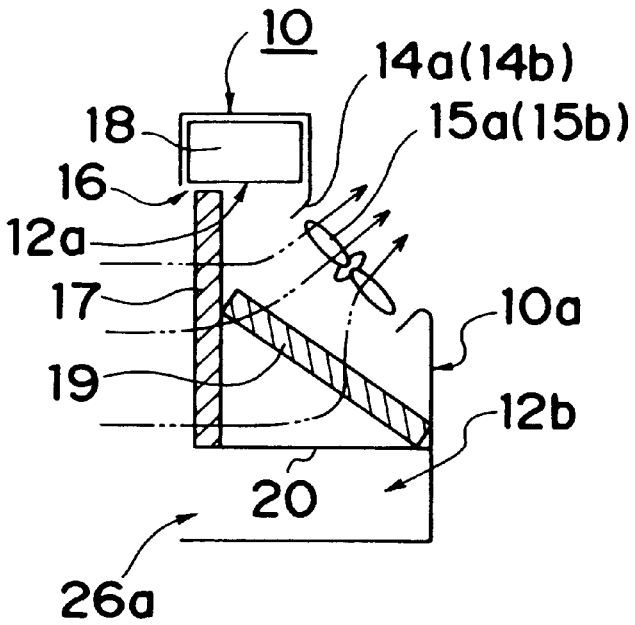
FIG. 6 is a sectional view of an air-cooling absorption type refrigerating apparatus according to a second embodiment of the present invention.

Next, FIG. 6 shows the construction of an air-cooled absorption type refrigerating apparatus according to a second embodiment of the present invention.

This embodiment is characterized in that, between the lower portion of the air-cooled absorber 17 and the lower portion of the air-cooled condenser 19 of the construction of the aforementioned first embodiment, there is provided a partition plate 20 for closing the space between the lower portions, thereby allowing only the wind that has passed through the air-cooled absorber 17 to pass through the air-cooled condenser 19.

Also with this construction, the circulation of air through the air-cooled absorber 17 and the air-cooled condenser 19 in the air stream path is improved similar to the first embodiment, so that a drift current through the air-cooled absorber 17 and the air-cooled condenser 19 is eliminated.

In this construction, the air-cooling condenser 19 is positioned completely on the downstream side of the air stream of the air-cooled absorber 17, however, the air-cooled condenser 19 is installed in positional correspondence with the lower portion of the air-cooled absorber 17 in which the absorbent has roughly finished its absorbing operation similar to the case of the first embodiment. Therefore, the temperature of air taken into the air-cooled condenser 19 does not increase so much, so that less influence is exerted on the condensation performance.

(Third Embodiment)

Figure 7:
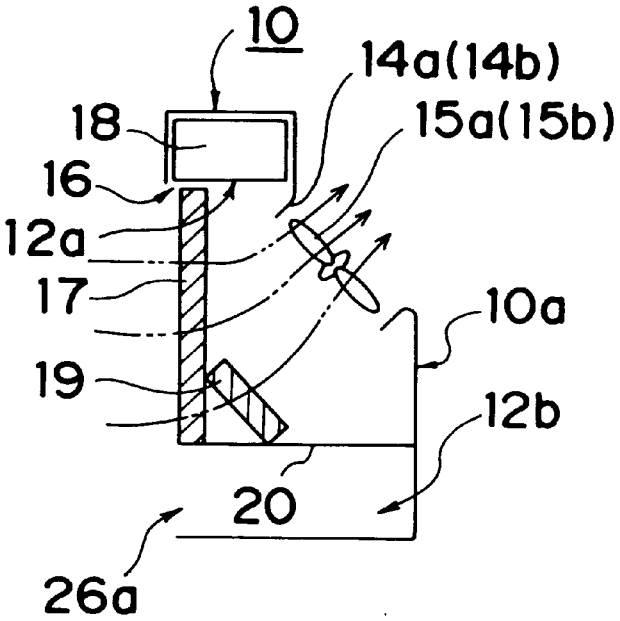
FIG. 7 is a sectional view of an air-cooling absorption type refrigerating apparatus according to a third embodiment of the present invention.
Figure 8:
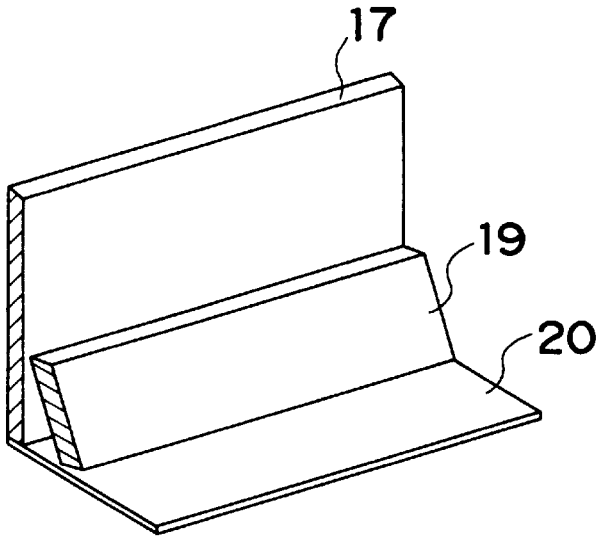
FIG. 8 is a perspective view of the essential part of the refrigerating apparatus of FIG. 7.
Figure 9:
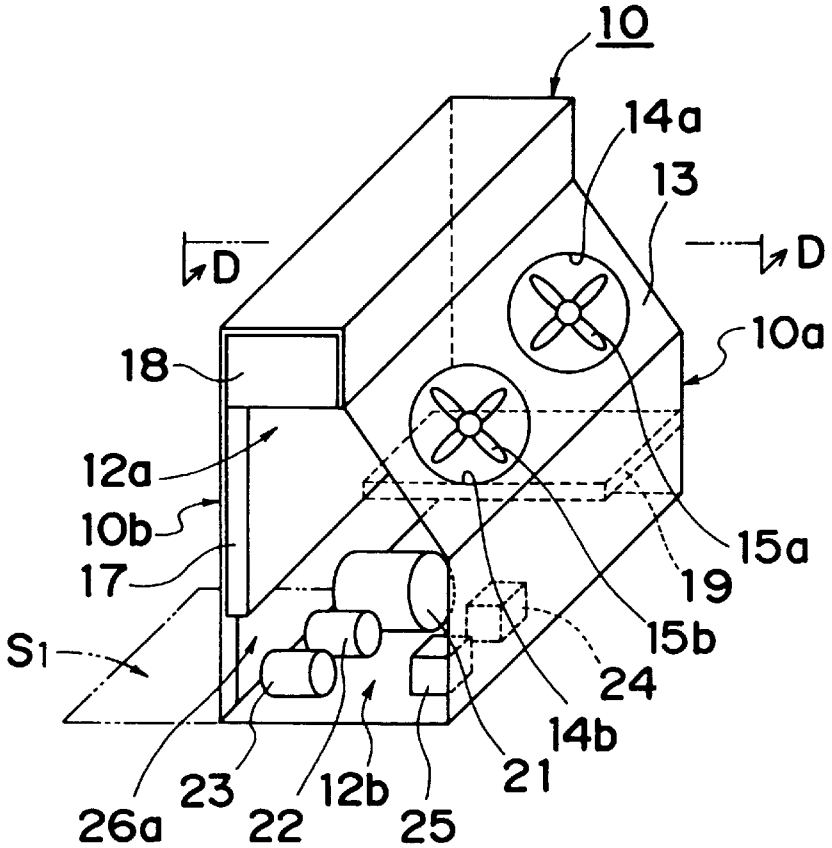
FIG. 9 is a partially cutaway perspective view of an air-cooling absorption type refrigerating apparatus according to a fourth embodiment of the present invention.
Figure 10:
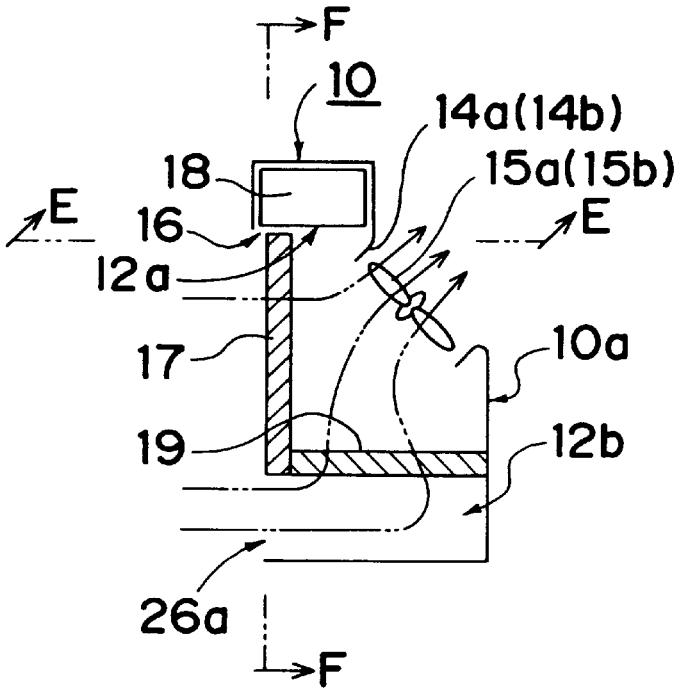
FIG. 10 is a sectional view of the above refrigerating apparatus along the line D—D in FIG. 9.

Next, FIG. 7 and FIG. 8 show the construction of an air-cooling absorption type refrigerating apparatus according to a third embodiment of the present invention.

This embodiment is characterized in that the air-cooled condenser 19 of the construction of the air-cooled absorption type refrigerating apparatus of the second embodiment is made to have a structure that has a small vertical width and a long lateral length and is arranged similarly aslant on the downstream side of the lower portion of the air-cooled absorber 17 as shown in detail in FIG. 7 and FIG. 8, and the partition plate 20 is extended from the lower portion of the air-cooling absorber 17 to the front surface side vertical wall section 10*a* of the apparatus main body 10.

In this construction, the air-cooling condenser 19 has a laterally elongated shape to secure a heat transmission area similar to that of the second embodiment and allow air to uniformly flow throughout the entire lateral dimension. Therefore, the first and second fans 15*a* and 15*b* can function equally.

This arrangement is also convenient for reducing the width in the depthwise direction of the apparatus main body 10.

(Fourth Embodiment)

Next, FIG. 9 through FIG. 12 show the construction of an air-cooled absorption type refrigerating apparatus according to a fourth embodiment of the present invention.

This embodiment is characterized in that the air-cooling condenser 19 of the construction of the first embodiment is arranged on the downstream side horizontally perpendicularly to the lower portion of the air-cooled absorber 17, so that the air-cooling absorber 17 and the air-cooling condenser 19 are made to independently take in air, only horizontally from the air inlet 16 to the former and only from the service opening 26*a* located below the air-cooling absorber 17 to the latter, thereby allowing air to pass through the air-cooling absorber 17 and the air-cooled condenser 19 particularly in a uniform air flow velocity distribution state.

Figure 11:
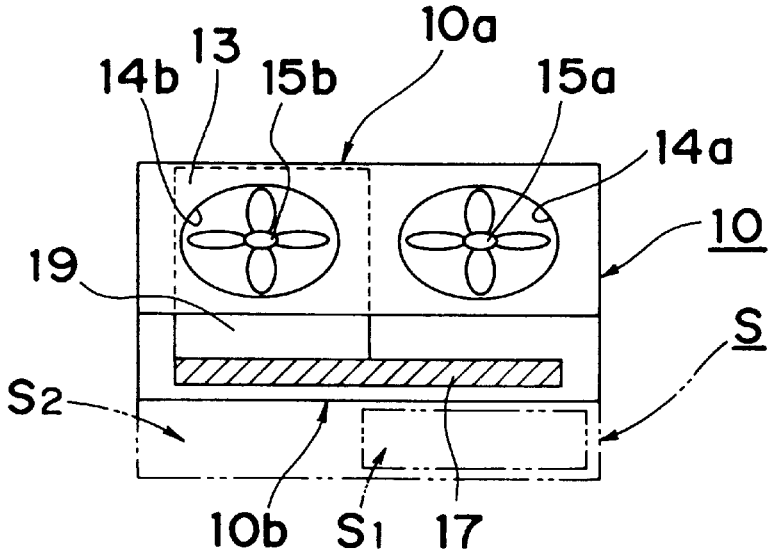
FIG. 11 is a sectional view of the above refrigerating apparatus along the line E—E in FIG. 10.
Figure 12:
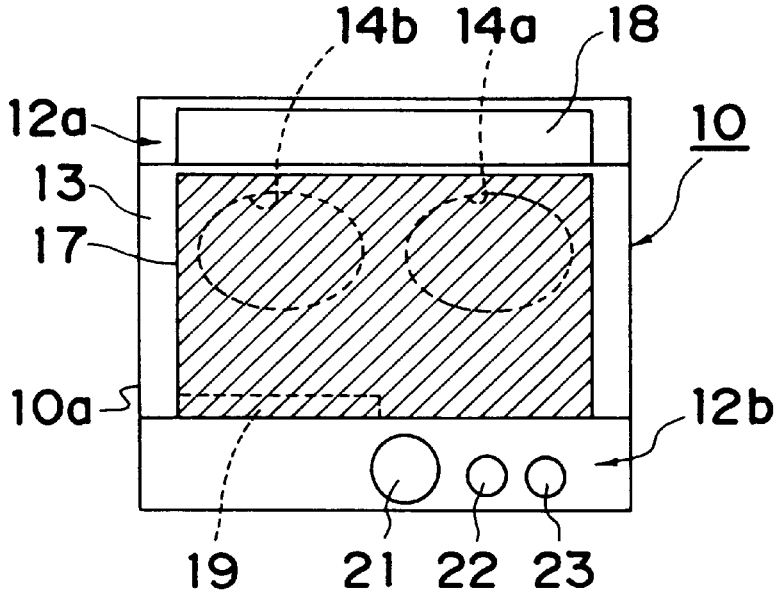
FIG. 12 is a sectional view of the above refrigerating apparatus along the line F—F in FIG. 10.

According to this construction, as shown in FIG. 11, the heat exchange performance of each of the air-cooled absorber 17 and the air-cooled condenser 19 is more sufficiently improved in an installation space similar to that of the first embodiment.

(Fifth Embodiment)

Figure 13:
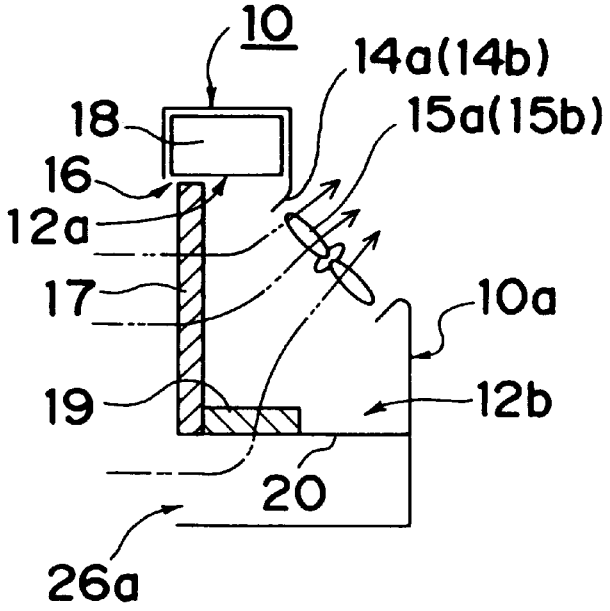
FIG. 13 is a sectional view of an air-cooling absorption type refrigerating apparatus according to a fifth embodiment of the present invention.

Next, FIG. 13 shows the construction of an air-cooled absorption type refrigerating apparatus according to a fifth embodiment of the present invention.

This embodiment is characterized in that the laterally elongated air-cooling condenser 19 of the construction of the third embodiment is arranged horizontally perpendicular to the lower portion of the air-cooled absorber 17 similar to the case of the fourth embodiment, and the partition plate 20 is provided between the front end side of the condenser and the front surface side vertical wall section 10*a* of the apparatus main body.

In the case of this construction, an effect similar to that of the fourth embodiment can also be obtained.

(Sixth Embodiment)

Figure 14:
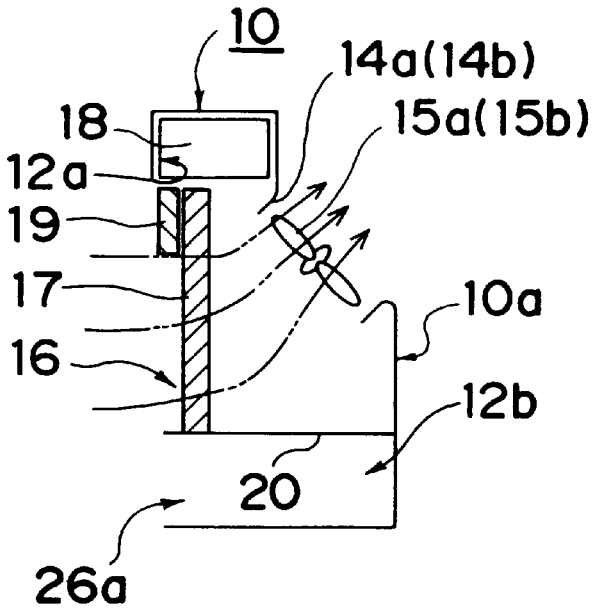
FIG. 14 is a sectional view of an air-cooling absorption type refrigerating apparatus according to a sixth embodiment of the present invention.

Next, FIG. 14 shows the construction of an air-cooled absorption type refrigerating apparatus according to a sixth embodiment of the present invention.

This embodiment is characterized in that the air-cooled condenser 19 is provided on the upstream side of the air stream in correspondence with the upper portion of the air-cooling absorber 17 when the air-cooled condenser 19 is formed into a laterally elongated shape with a narrow vertical width as in the construction of the third embodiment, and the partition plate 20 is provided between the lower portion of the air-cooled absorber 17 and the front surface side vertical wall section 10*a* of the apparatus main body 10.

In the air-cooled absorber 17, the absorbing operation progresses downwardly from the upper portion, and therefore, a relatively high temperature is there in the upper portion. Therefore, a sufficient air temperature difference for the cooling can be assured even when the air-cooled condenser 19 is provided on the upstream side.

(Seventh Embodiment)

Figure 15:
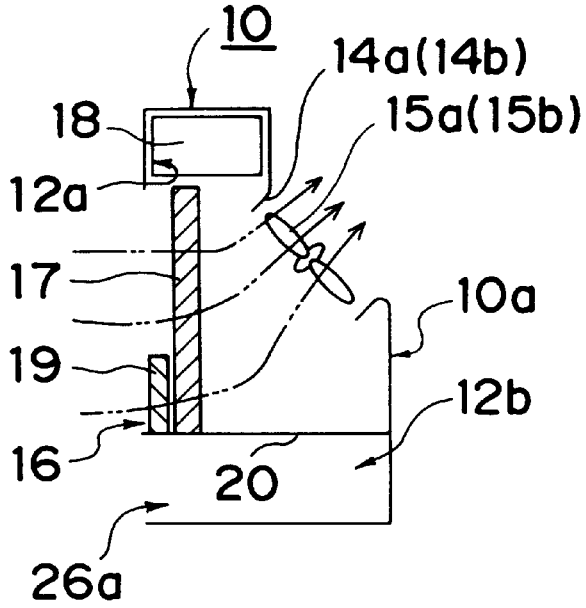
FIG. 15 is a sectional view of an air-cooling absorption type refrigerating apparatus according to a seventh embodiment of the present invention.

Next, FIG. 15 shows the construction of an air-cooled absorption type refrigerating apparatus according to a seventh embodiment of the present invention.

This embodiment is characterized in that the air-cooled condenser 19 of the construction of the air-cooled absorption type refrigerating apparatus of the sixth embodiment is shifted directly to the lower side of the air-cooled absorber 17. As described above, even if the air-cooled condenser 19 is provided on the upstream side of the air stream of the air-cooling absorber 17, then the absorbing operation progresses from the upper side to the lower side in the air-cooling absorber 17, and therefore, the absorbent fluid temperature is high on the upper side. Assuming that the temperature of air taken into the air-cooled absorber 17 increases to some extent due to the heat exchange at the air-cooled condenser 19 provided on the upstream side, then the temperature difference between the taken air and the absorbent fluid of the air-cooled absorber 17 can be sufficiently secured, and therefore, the heat exchange on the air-cooled absorber 17 side can be sufficiently performed. The sixth embodiment is constructed from this viewpoint.

However, in order to obtain a higher heat exchange performance of the air-cooled absorber 17 itself, it is better that the air-cooling condenser 19 should not exist on the upstream side of the upper portion of the air-cooled absorber 17 where the absorbent fluid temperature is high.

Then, the absorbing operation progresses from the upper side to the lower side in the air-cooled absorber 17 as described above and the absorbing operation is roughly completed in the lower side portion. Accordingly, there is a low degree of requirement for cooling in the lower side portion, so that less influence is exerted on the air-cooling absorber by the increased air temperature due to the heat exchange at the air-cooled condenser 19.

Accordingly, the present embodiment is constructed in view of the above to provide the air-cooled condenser 19 on the lower side portion having less contribution to the heat radiation of the absorbed heat of the air-cooled absorber 17 even on the upstream side of the air-cooled absorber 17, so that the effective heat exchange performance of the air-cooled absorber 17 is not hindered.

(Eighth Embodiment)

Figure 16:
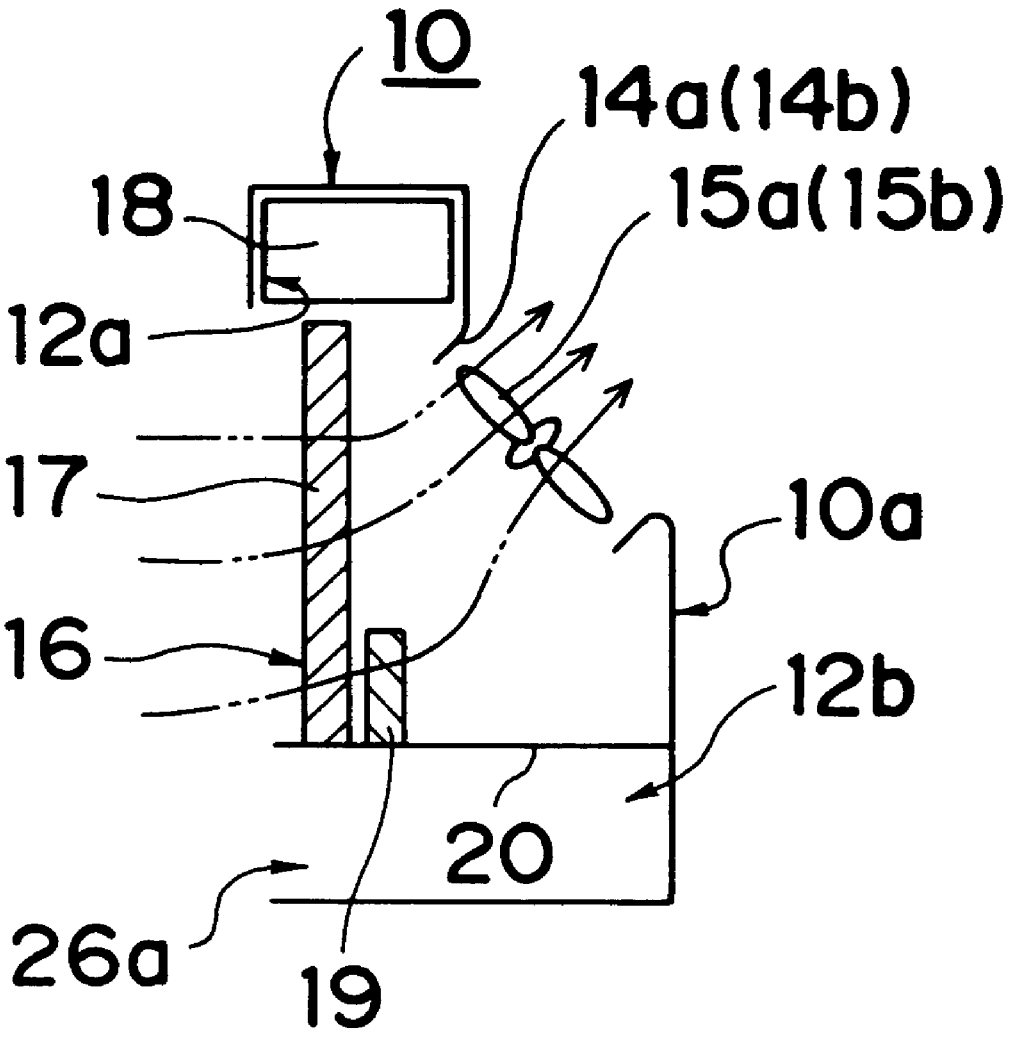
FIG. 16 is a sectional view of an air-cooling absorption type refrigerating apparatus according to an eighth embodiment of the present invention.
Figure 17:
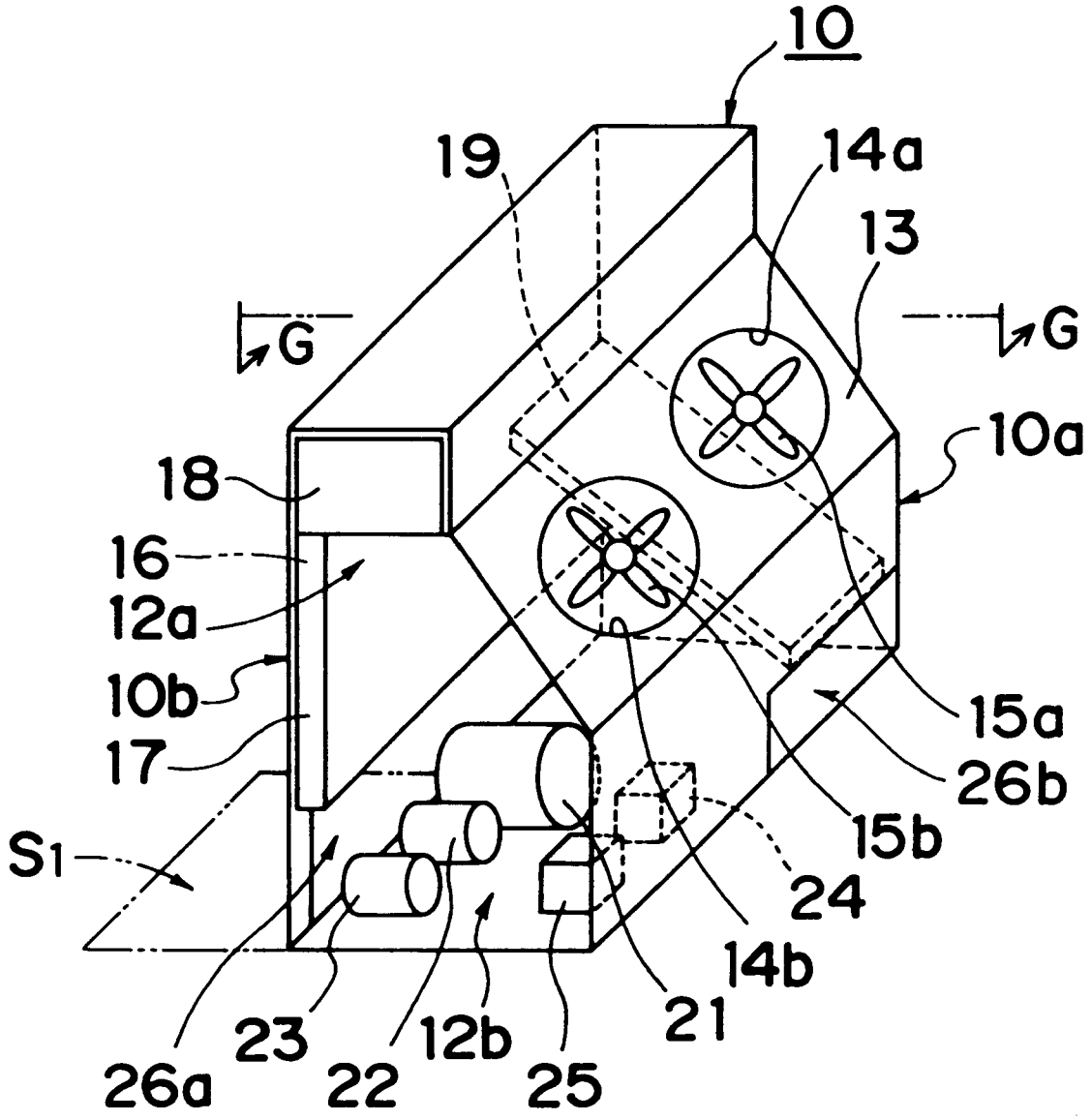
FIG. 17 is a partially cutaway perspective view of an air-cooling absorption type refrigerating apparatus according to a ninth embodiment of the present invention.

Next, FIG. 16 shows the construction of an air-cooled absorption type refrigerating apparatus according to an eighth embodiment of the present invention.

This embodiment is characterized in that the laterally elongated air-cooled condenser 19 of the construction of the air-cooled absorption type refrigerating apparatus similar to the sixth and seventh embodiments is provided on the downstream side of the air stream in correspondence with the lower portion of the air-cooled absorber 17 in the air stream path partitioned by the partition plate 20.

By adopting this construction, the apparatus main body 10 is allowed to have a thin and compact shape and a reduced installation area similar to the aforementioned embodiments, and the flow velocity distribution of the air streams passing through the air-cooled absorber 17 and the air-cooled condenser 19 become uniform, and the heat exchange performances of them are improved.

Furthermore, by virtue of the provision of the air-cooled condenser 19 located on the downstream side of the air stream of the air-cooled absorber 17, there is no possibility of the occurrence of a reduction in absorption performance as a consequence of an increase in temperature of the air taken into the air-cooled absorber 17 due to the heat exchange through the air-cooled condenser 19 as observed in the prior art. As a result, the air-cooled absorber 17 can be compacted to allow the absorption type refrigerating apparatus main body to be compacted for the contribution to the cost reduction of the apparatus.

Furthermore, although the air-cooled condenser 19 is positioned on the downstream side of the air stream, the air-cooled condenser 19 is installed in positional correspondence with the lower portion of the air-cooled absorber 17 in which the absorbant has roughly finished its absorbing operation. Therefore, the temperature of the air taken into the air-cooling condenser 19 does not increase so much, so that less influence is exerted on the condensation performance.

(Ninth Embodiment)

Next, FIG. 17 through FIG. 20 show the construction of an air-cooled absorption type refrigerating apparatus according to a ninth embodiment of the present invention.

This embodiment is characterized in that a front surface side air inlet 26*b* corresponding particularly to the air-cooled condenser 19 is formed in a lower portion of the front surface side vertical wall section 10*a* of the apparatus main body 10 based on the construction of the air-cooled absorption type refrigerating apparatus of the first embodiment.

Figure 18:
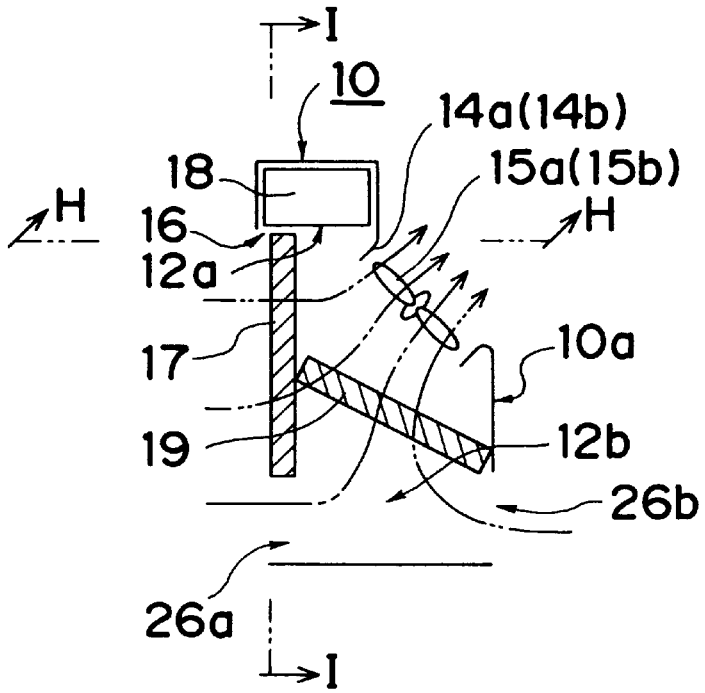
FIG. 18 is a sectional view of the above refrigerating apparatus along the line G—G in FIG. 17.
Figure 19:
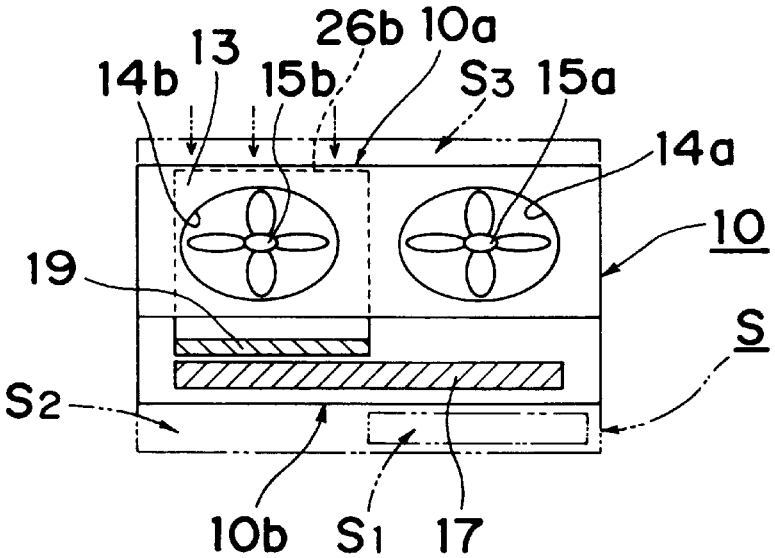
FIG. 19 is a sectional view of the above refrigerating apparatus along the line H—H in FIG. 18.
Figure 20:
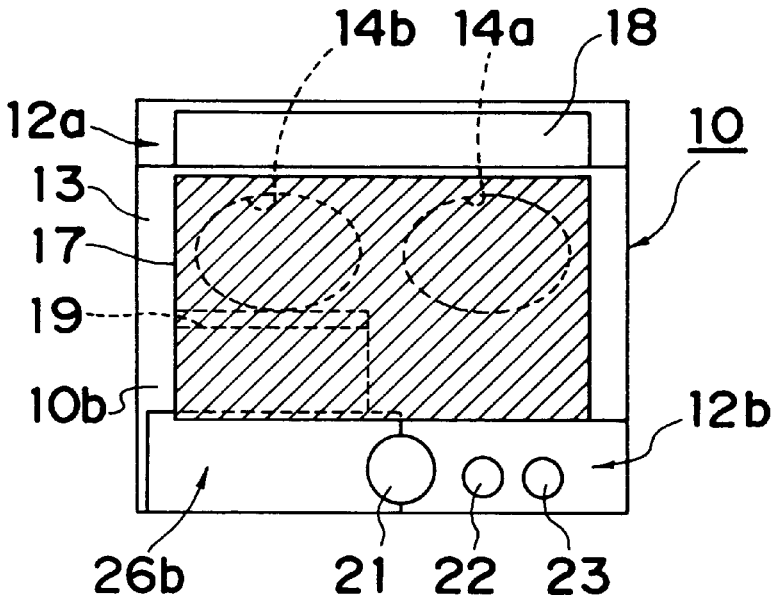
FIG. 20 is a sectional view of the above refrigerating apparatus along the line I—I in FIG. 18.

According to this construction, as shown in FIG. 18, there is provided two air supply routes of the rear surface side service opening 26*a* and the front surface side air inlet 26*b* particularly for the air-cooled condenser 19. Therefore, the air flow rate distribution becomes more uniform to allow the heat exchange performance to be improved. As a result, as shown in FIG. 19, the rear surface side air intake space $S_2$ can be reduced, thereby allowing the space $S_2$ to be adjusted with respect to the front surface side space $S_3$.

(Tenth Embodiment)

Figure 21:
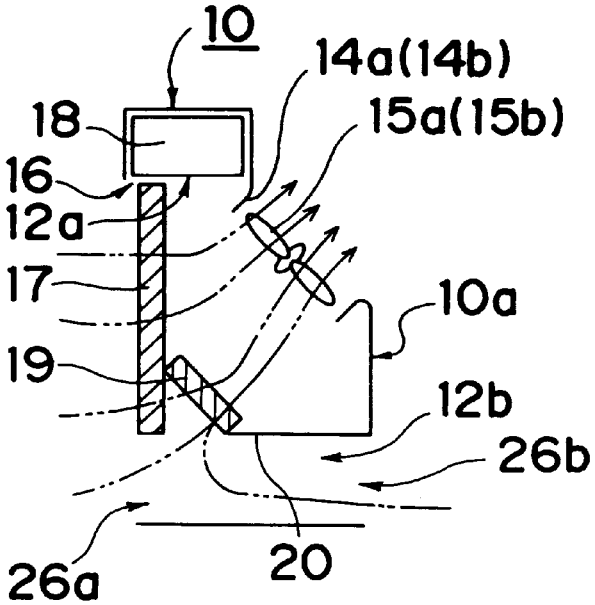
FIG. 21 is a sectional view of an air-cooling absorption type refrigerating apparatus according to a tenth embodiment of the present invention.

Next, FIG. 21 shows the construction of an air-cooled absorption type refrigerating apparatus according to a tenth embodiment of the present invention.

This embodiment is characterized in that a front surface side air inlet 26*b* is formed laterally throughout the entire portion of the front surface side vertical wall section 10*a* of the apparatus main body 10 as in the ninth embodiment and the partition plate 20 located between the lower portion of the air-cooled absorber 17 and the lower portion of the air-cooling condenser 19 is removed as to the construction of the air-cooling absorption type refrigerating apparatus of the third embodiment.

According to this construction, an effect similar to that of the ninth embodiment can be achieved in addition to the effect of the third embodiment.

(Eleventh Embodiment)

Figure 22:
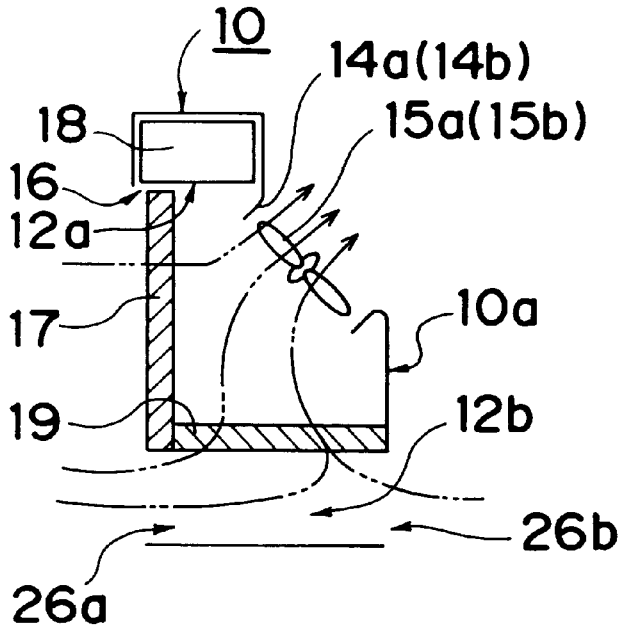
FIG. 22 is a sectional view of an air-cooling absorption type refrigerating apparatus according to an eleventh embodiment of the present invention.

Next, FIG. 22 shows the construction of an air-cooled absorption type refrigerating apparatus according to an eleventh embodiment of the present invention.

This embodiment is characterized in that the front surface side air inlet 26*b* is formed in the front surface side vertical wall section 10*a* of the apparatus main body 10 similar to the ninth and tenth embodiments as to the construction of the air-cooled absorption type refrigerating apparatus of the fourth embodiment.

Even with this construction, the heat exchange performance of the air-cooled condenser 19 can be improved similar to the ninth and tenth embodiments.

(Twelfth Embodiment)

Figure 23:
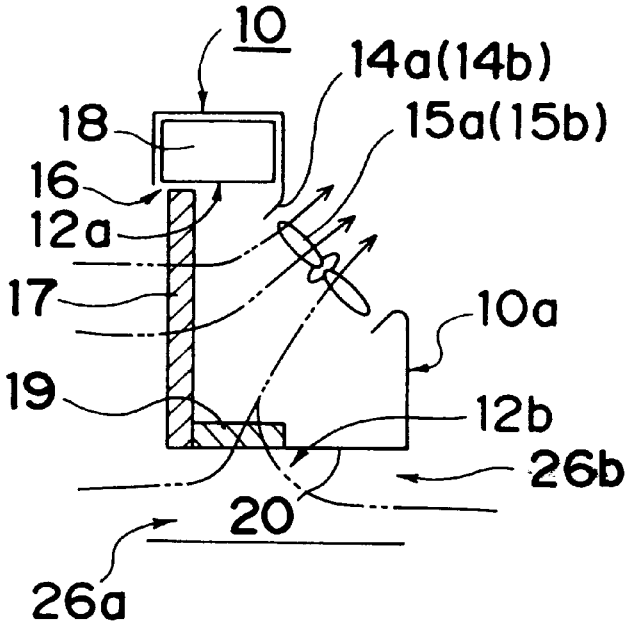
FIG. 23 is a sectional view of an air-cooling absorption type refrigerating apparatus according to a twelfth embodiment of the present invention.

Next, FIG. 23 shows the construction of an air-cooled absorption type refrigerating apparatus according to a twelfth embodiment of the present invention.

This embodiment is characterized in that the front surface side air inlet 26*b* is formed at the front surface side vertical wall section 10*a* of the apparatus main body 10 similar to the ninth and tenth embodiments as to the construction of the air-cooled absorption type refrigerating apparatus of the fifth embodiment.

Even with this construction, the heat exchange performance of the air-cooling condenser 19 can be improved similar to the ninth and tenth embodiments.

(Thirteenth Embodiment)

Figure 24:
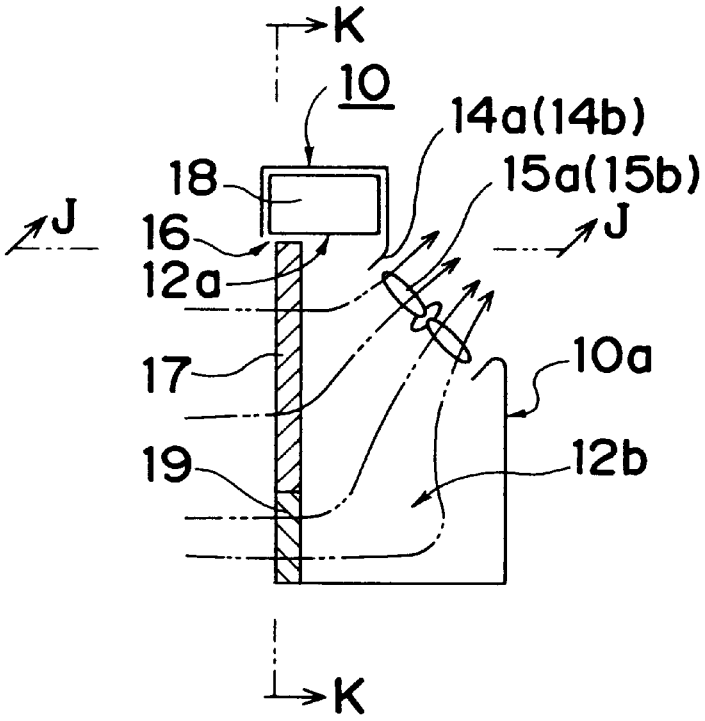
FIG. 24 is a sectional view of an air-cooling absorption type refrigerating apparatus according to a thirteenth embodiment of the present invention.
Figure 25:
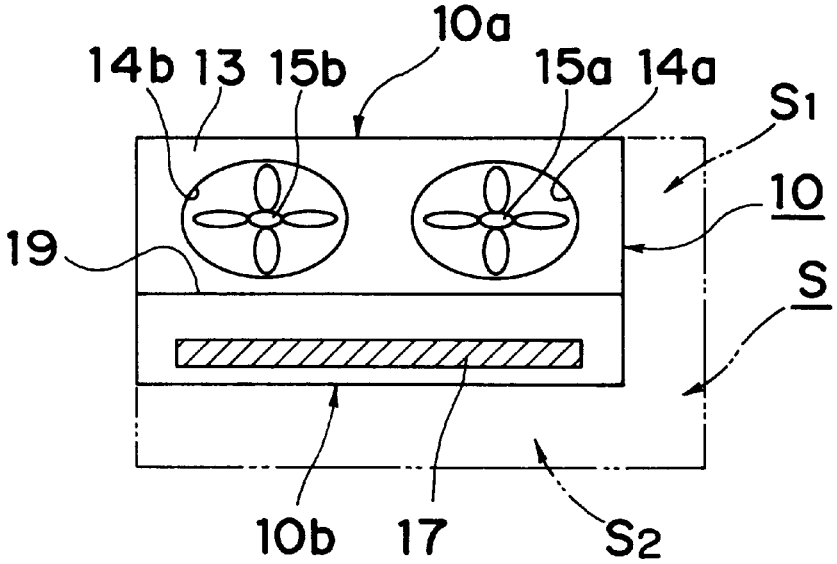
FIG. 25 is a sectional view of the above refrigerating apparatus along the line J—J in FIG. 24.
Figure 26:
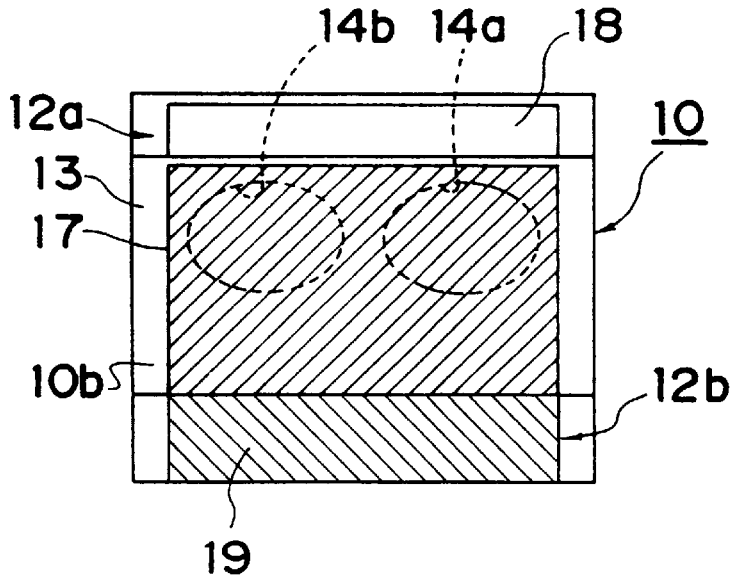
FIG. 26 is a sectional view of the above refrigerating apparatus along the line K—K in FIG. 24.

FIG. 24 through FIG. 26 show the construction of an air-cooled absorption type refrigerating apparatus according to a thirteenth embodiment of the present invention.

This embodiment is characterized in that the air-cooled absorber 17, the evaporator 18 and the first and second fans 15*a* and 15*b* are similar to those of the construction of the air-cooled absorption type refrigerating apparatus of the first embodiment. In the case of the present embodiment, by adopting, for example, a single-effect type absorption refrigerating circuit construction (see FIG. 27), the refrigerator pump 22 for supplying condensed water from the air-cooled condenser 19 to the evaporator 18 is eliminated, and thereby the air-cooled condenser 19 is installed continuously to the air-cooled absorber 17 in an empty space below the air-cooled absorber 17.

When this construction is adopted, the apparatus main body 10 is allowed to have a thin and compact shape and a reduced installation area similar to the case of the aforementioned embodiments, and the air-cooling absorber 17 as well as the air-cooled condenser 19 become a heat exchanger of a roughly single-plate structure, by which the flow velocity distribution of the air stream passing therethrough becomes more uniform to allow the heat exchange performance of each of them is further improved.

Figure 27:
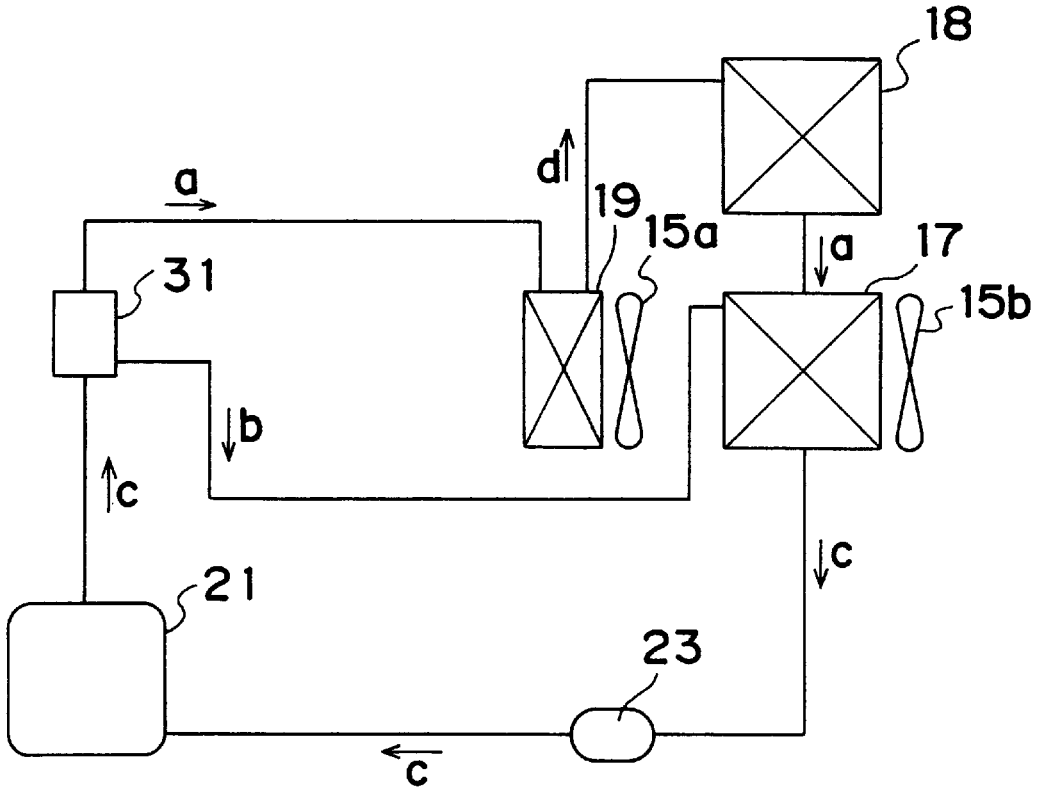
FIG. 27 is a refrigerating circuit diagram of the above refrigerating apparatus.

Next, FIG. 27 shows the construction of a refrigerating circuit of an air-cooling single effect absorption type refrigerating apparatus adopting a refrigerant-pump-less system as described above.

The air-cooled absorption type refrigerating apparatus shown in FIG. 27 adopts a lithium bromide aqueous solution (LiBr aqueous solution) as the absorbent fluid and adopts water vapor as the refrigerant (fluid subjected to absorption) as described above.

In FIG. 27, first, the reference numeral 21 denotes a high-temperature regenerator, which is provided with a heat applying source such as a gas burner. Above this high-temperature regenerator 21 is provided a vapor-liquid separator 31 communicated via a liquid lift pipe. In the above high-temperature regenerator 21, a dilute lithium bromide solution "c" that has been used for absorption is heated and boiled to be supplied to the vapor-liquid separator 31 positioned upward via the liquid lift pipe, where the solution is regenerated and separated into water vapor "a" and a concentrated lithium bromide solution "b".

The above dilute lithium bromide solution "c" is obtained by absorbing the water vapor "a" that serves as the refrigerant vapor into the concentrated lithium bromide solution "b" that serves as the absorbent fluid in the air-cooled absorber 17 as described later and thereafter conveyed back to the high-temperature regenerator 21 from the air-cooled absorber 17 by the solution pump 23.

The water vapor "a" separated by the vapor-liquid separator 31 is conveyed to the air-cooled condenser 19, while the concentrated lithium bromide solution "b" is supplied to the air-cooled absorber 17.

The water vapor "a" supplied to the air-cooled condenser 19 is condensed into a condensed water "d" in this air-cooling condenser 19 and then supplied to the evaporator 18 by a pressure difference between the air-cooled condenser 19 and the evaporator 18 not by way of a refrigerator pump 22 as shown in FIG. 5. The concentrated lithium bromide solution "b" absorbs the water vapor "a" supplied from the evaporator 18 so as to become the dilute lithium bromide solution "c" in the air-cooled absorber 17.

Then, the dilute lithium bromide solution "c" taken out of the air-cooled absorber 17 is conveyed back to the high-temperature regenerator 21 by the solution pump 23.

(Fourteenth Embodiment)

Figure 28:
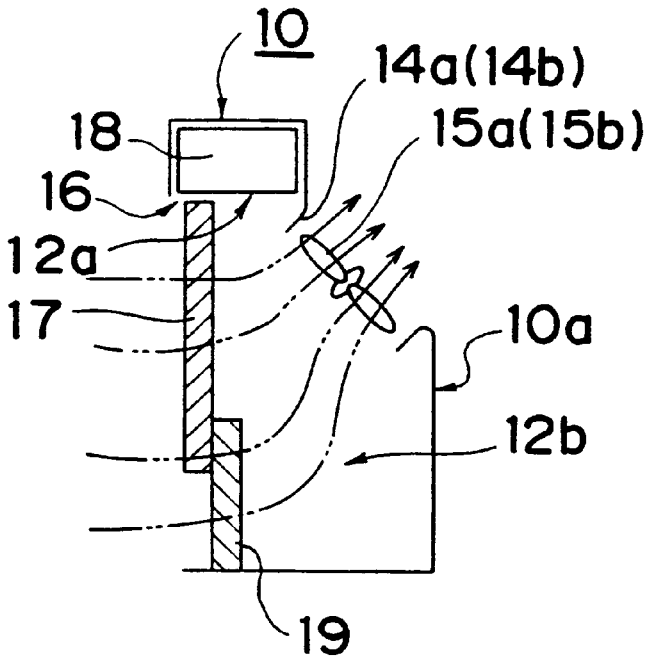
FIG. 28 is a sectional view of an air-cooling absorption type refrigerating apparatus according to a fourteenth embodiment of the present invention.

Next, FIG. 28 shows the construction of an air-cooled absorption type refrigerating apparatus according to a fourteenth embodiment of the present invention.

This embodiment is characterized in that the air-cooled condenser 19 of the construction of the air-cooled absorption type refrigerating apparatus of the thirteenth embodiment is made to have a slightly increased vertical width to increase the heat transmission area and provided upright in a state in which the condenser slightly overlaps on the downstream side the lower portion of the air-cooled absorber 17.

Even with this construction, the lower portion of the air-cooled absorber 17 contributes less to heat exchange as described above, and therefore, an effect similar to that of the thirteenth embodiment can be obtained.

(Fifteenth Embodiment)

Figure 29:
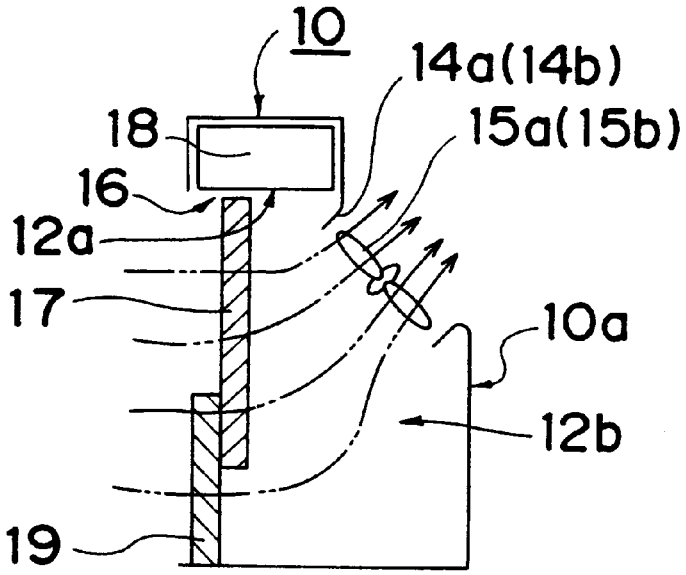
FIG. 29 is a sectional view of an air-cooling absorption type refrigerating apparatus according to a fifteenth embodiment of the present invention.

Next, FIG. 29 shows the construction of an air-cooled absorption type refrigerating apparatus according to a fifteenth embodiment of the present invention.

This embodiment is characterized in that the air-cooled condenser 19 of the construction of the air-cooled absorption type refrigerating apparatus of the thirteenth embodiment is made to have a slightly increased vertical width to increase the heat transmission area and provided upright in a state in which the condenser slightly overlaps on the upstream side the lower portion of the air-cooled absorber 17 conversely to the fourteenth embodiment.

Even with this construction, the lower portion of the air-cooled absorber 17 contributes less to heat exchange as described above, and therefore, an effect similar to those of the thirteenth and fourteenth embodiments can be obtained.

(Sixteenth Embodiment)

Figure 30:
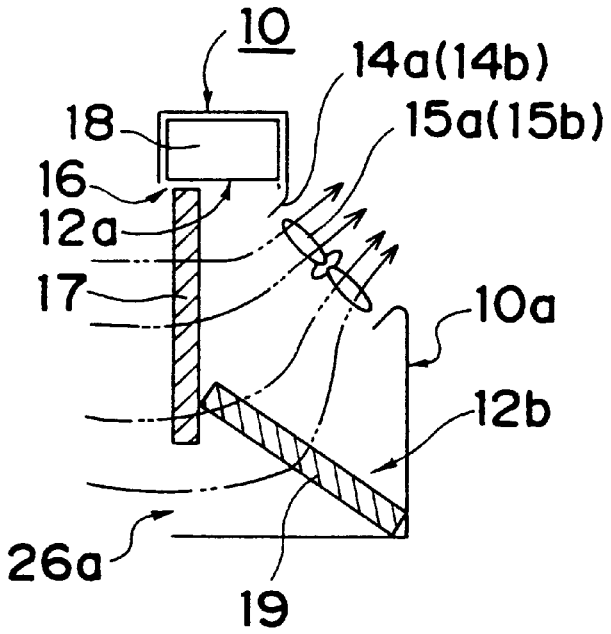
FIG. 30 is a sectional view of an air-cooling absorption type refrigerating apparatus according to a sixteenth embodiment of the present invention.

Next, FIG. 30 shows the construction of an air-cooled absorption type refrigerating apparatus according to a sixteenth embodiment of the present invention.

This embodiment is characterized in that an air-cooled condenser 19 having a wide depthwise heat transmission area similar to the air-cooling condenser 19 of the construction of the air-cooled absorption type refrigerating apparatus of the first embodiment is provided aslant in a state in which the condenser slightly overlaps on the downstream side the lower portion of the air-cooled absorber 17, and air is supplied from the service opening 26*a* located below the air-cooled absorber 17.

Even with this construction, the lower portion of the air-cooled absorber 17 contributes less to heat exchange as described above, and therefore, an effect similar to those of the thirteenth through fifteenth embodiments can be obtained.

(Seventeenth Embodiment)

Figure 31:
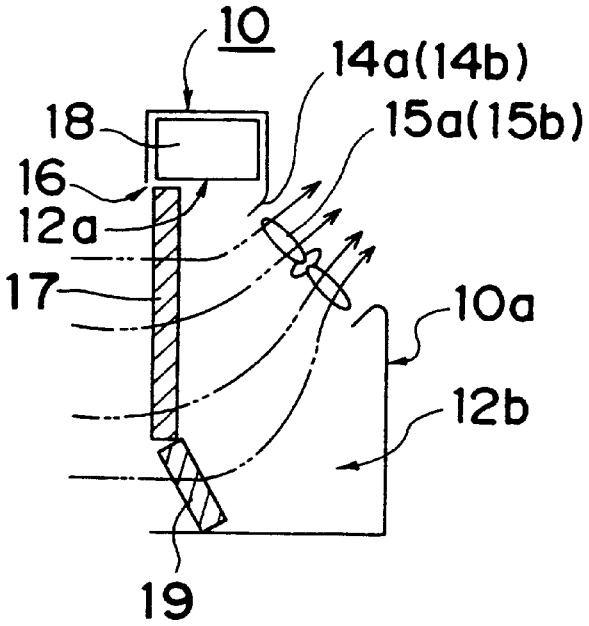
FIG. 31 is a sectional view of an air-cooling absorption type refrigerating apparatus according to a seventeenth embodiment of the present invention.

Next, FIG. 31 shows the construction of an air-cooled absorption type refrigerating apparatus according to a seventeenth embodiment of the present invention.

This embodiment is characterized in that a laterally elongated air-cooled condenser 19 similar to that of the construction of the air-cooling absorption type refrigerating apparatus of the third embodiment is provided below the air-cooled absorber 17 similar to the thirteenth embodiment and put into a slightly inclined state, and air is supplied via the service opening 26*a* roughly in a similar manner.

Even with this construction, an effect similar to those of the thirteenth through sixteenth embodiments can be obtained.

(Eighteenth Embodiment)

Figure 32:
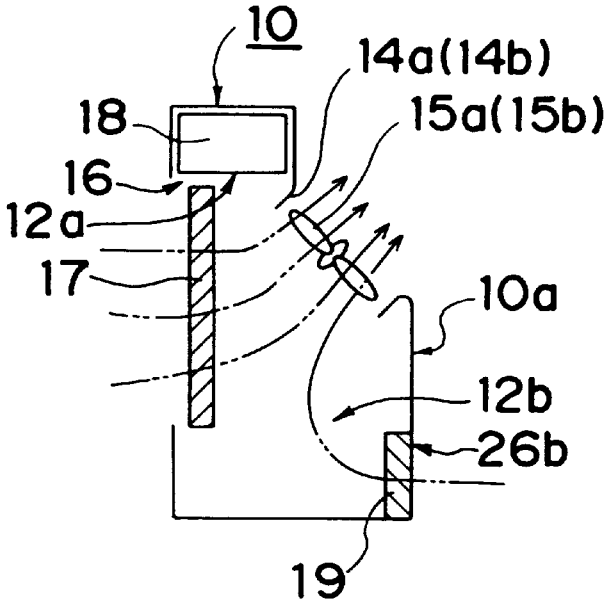
FIG. 32 is a sectional view of an air-cooling absorption type refrigerating apparatus according to an eighteenth embodiment of the present invention.

Next, FIG. 32 shows the construction of an air-cooled absorption type refrigerating apparatus according to an eighteenth embodiment of the present invention.

This embodiment is characterized in that a laterally elongated air-cooled condenser 19 is employed as in the construction of the air-cooled absorption type refrigerating apparatus of the tenth embodiment and the front surface side vertical wall section 10*a* of the apparatus main body 10 is provided with the front surface side air inlet 26*b*, where the air-cooled condenser 19 is arranged upright in the front surface side air inlet 26*b*.

When this construction is adopted, an air inlet is formed on both the rear surface side and the front surface side of the apparatus main body 10 similar to the case of the tenth embodiment, consequently allowing the air intake space on the rear surface side to be small. Particularly in the present embodiment, the air-cooled absorber 17 and the air-cooled condenser 19 have independent air inlets, and therefore, the flow velocity distribution of air passing through each of them becomes more uniform.

(Nineteenth Embodiment)

Figure 33:
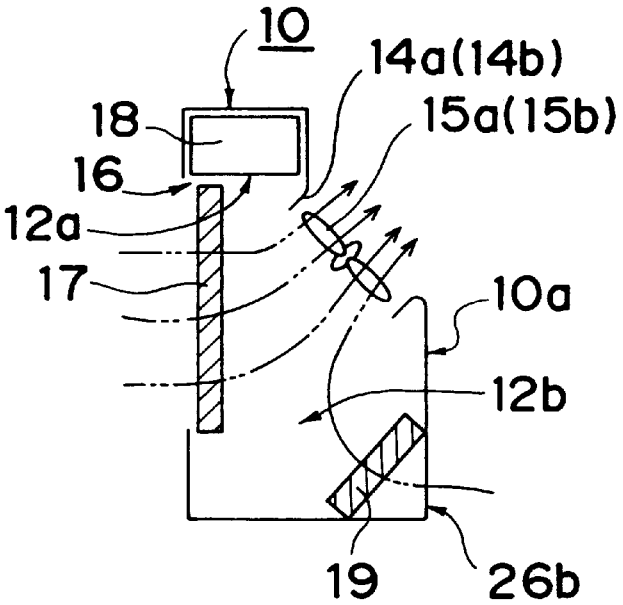
FIG. 33 is a sectional view of an air-cooling absorption type refrigerating apparatus according to a nineteenth embodiment of the present invention.

Next, FIG. 33 shows the construction of an air-cooled absorption type refrigerating apparatus according to a nineteenth embodiment of the present invention.

This embodiment is characterized in that the air-cooled condenser 19 of the construction of the air-cooled absorption type refrigerating apparatus of the eighteenth embodiment is installed aslant.

When this construction is adopted, the vertical width of the air-cooled condenser 19 can be increased in addition to the effect similar to the aforementioned effect, so that the heat transmission area is increased.

(Twentieth Embodiment)

Figure 34:
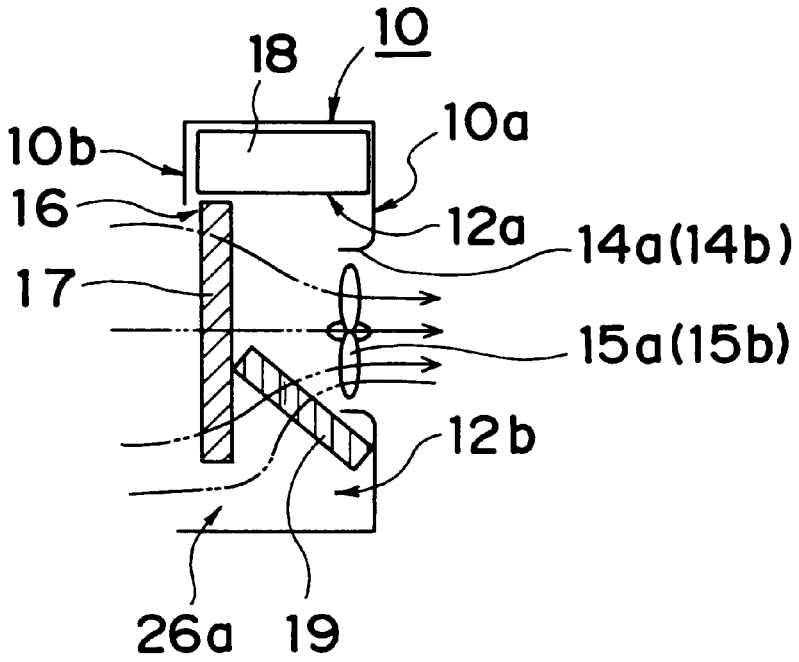
FIG. 34 is a sectional view of an air-cooling absorption type refrigerating apparatus according to a twentieth embodiment of the present invention.
Figure 35:
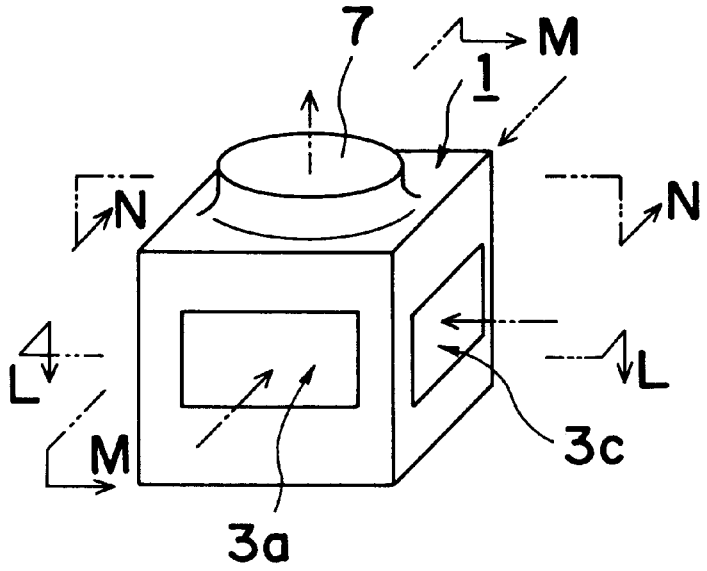
FIG. 35 is a perspective view of the apparatus main body of a prior art air-cooling absorption type refrigerating apparatus.
Figure 36:
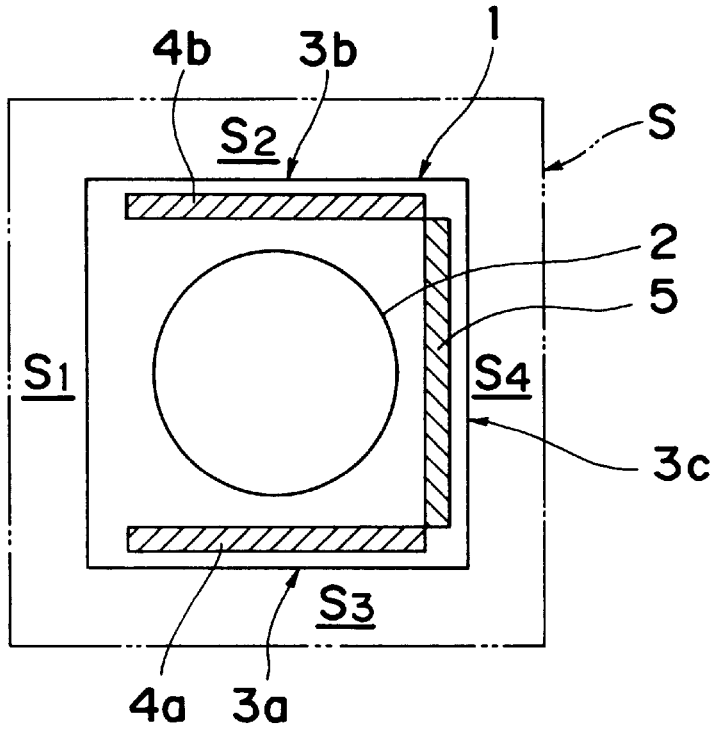
FIG. 36 is a sectional view of the above refrigerating apparatus along the line L—L in FIG. 35.
Figure 37:
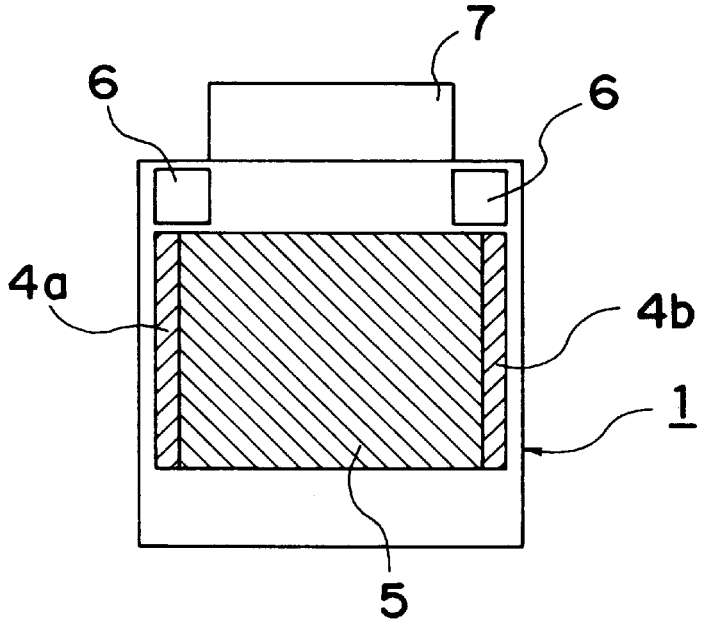
FIG. 37 is a sectional view of the above refrigerating apparatus along the line M—M in FIG. 35.
Figure 38:
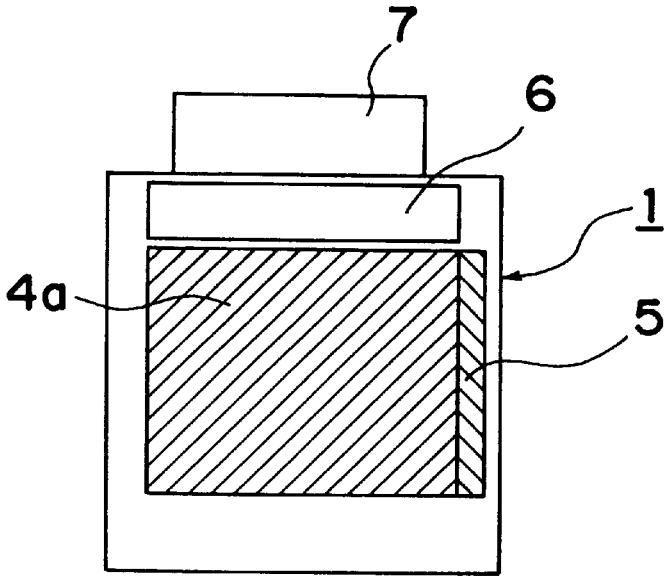
FIG. 38 is a sectional view of the above refrigerating apparatus along the line N—N in FIG. 35.
Figure 39:
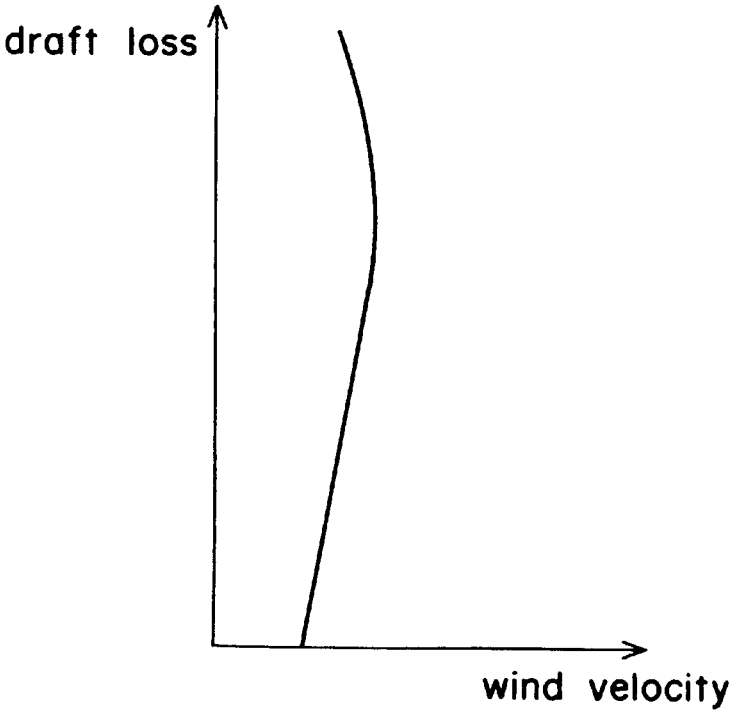
FIG. 39 is a graph showing a "wind velocity to draft loss" characteristic of the apparatus main body of the above prior art air-cooling absorption type refrigerating apparatus.

Next, FIG. 34 shows the construction of an air-cooled absorption type refrigerating apparatus according to a twentieth embodiment of the present invention.

This embodiment is characterized in that the front surface side vertical wall section 10*a* of the apparatus main body 10 is made to have a straight plane and the first and second air outlets 14*a* and 14*b* and the first and second fans 15*a* and 15*b* are both arranged in the horizontal direction parallel to the air inlet 16 in contrast to the fact that the air-cooled absorption type refrigerating apparatus of each of the aforementioned embodiments has the construction in which the front surface side vertical wall section 10*a* of the apparatus main body 10 is provided in the form of the slant surface section 13 of the trapezoidal shape and the first and second air outlets 14*a* and 14*b* and the first and second fans 15*a* and 15*b* are provided while being inclined upwardly aslant.

This construction is able to obtain an effect similar to that of each of the embodiments and have a thinner profile by virtue of the elimination of the slant surface as is apparent from FIG. 34, by which the air stream distribution of the air-cooled absorber 17 becomes more uniform, providing the merit of improving the absorption and condensation performances.

Furthermore, in this case, if the apparatus is constructed by making the width in the depthwise direction of the upside inner space 12*a* of the apparatus main body 10 equal to the width in the depthwise direction of the downside inner space 12*b* of the first embodiment as described above, then the width in the depthwise direction of the evaporator 18 itself is also allowed to have an increased width in the depthwise direction. Therefore, the evaporator 18 is allowed to be thinned by that much and have a reduced vertical height.

Even in the case of the air outlet and horizontal fan rotary axis installation structure as described above, the layout of the air-cooled absorber 17 and the air-cooled condenser 19 can be freely selected from the constructions of the aforementioned first through nineteenth embodiments.

INDUSTRIAL APPLICABILITY

The present invention is used for an air-cooled absorption type refrigerating apparatus. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-cooled absorption type refrigerating apparatus, comprising:

an apparatus main body having a front surface, a left side surface, a right side surface and a rear surface forming a compartment therebetween;

an air inlet formed in a single surface in the rear surface of the apparatus main body;

an air stream path extending from the air inlet in a single surface in the rear surface of the apparatus main body to an air outlet that is formed also in a single surface provided in the opposite direction and an air-cooled absorber and an air-cooled condenser are arranged in the air stream path.

2. The air-cooled absorption type refrigerating apparatus as claimed in claim 1, wherein the air outlet is arranged upwardly aslant, and a fan is provided with its fan axis arranged upwardly aslant in correspondence with the air outlet.

3. The air-cooled absorption type refrigerating apparatus as claimed in claim 1, wherein the air outlet is arranged parallel to the air inlet and the fan is provided with its fan axis arranged in a direction of air blown out of the air outlet.

4. The air-cooled absorption type refrigerating apparatus as claimed in any one of claims 1 to 3, wherein the air-cooling condenser is provided in a downstream position of the air-cooled absorber in the air stream path.

5. The air-cooled absorption type refrigerating apparatus as claimed in claim 1, wherein said air-cooled absorber is disposed downstream of said air-cooled condenser.

6. The air-cooled absorption type refrigerating apparatus as claimed in claim 1, wherein said air-cooled absorber and said air-cooled condenser are in alignment relative to each other and are exposed to separate air streams from said air inlet to said air outlet.

7. The air-cooled absorption type refrigerating apparatus as claimed in claim 1, wherein said air-cooled absorber and said air-cooled condenser are disposed at an angle relative to each other and are exposed to separate air streams from said air inlet to said air outlet.

8. An air-cooled absorption type refrigerating apparatus, comprising:

an apparatus main body having a front surface, a left side surface, a right side surface and a rear surface forming a compartment therebetween;

an air inlet formed in a single surface in the rear surface of the apparatus main body and used partially as a maintenance opening for necessary units of a refrigerating apparatus;

an air stream path extending from the air inlet in a single surface in the rear surface of the apparatus main body to an air outlet that is formed also in a single surface in the front surface of the apparatus, said air outlet being provided in the opposite direction;

an air-cooled absorber operatively positioned within said air stream path; and an air-cooling condenser operatively positioned within said air stream path.

9. The air-cooled absorption type refrigerating apparatus as claimed in claim 8, wherein the air outlet is arranged upwardly aslant, and a fan is provided with its fan axis arranged upwardly aslant in correspondence with the air outlet.

10. The air-cooled absorption type refrigerating apparatus as claimed in claim 8, wherein the air outlet is arranged parallel to the air inlet and the fan is provided with its fan axis arranged in a direction of air blown out of the air outlet.

11. The air-cooled absorption type refrigerating apparatus as claimed in any one of claims 8 to 10, wherein the air-cooled condenser is provided in a downstream position of the air-cooled absorber in the air stream path.

12. The air-cooled absorption type refrigerating apparatus as claimed in claim 8, wherein said air-cooled absorber is disposed downstream of said air-cooling condenser.

13. The air-cooled absorption type refrigerating apparatus as claimed in claim 8, wherein said air-cooled absorber and said air-cooled condenser are in alignment relative to each other and are exposed to separate air streams from said air inlet to said air outlet.

14. The air-cooled absorption type refrigerating apparatus as claimed in claim 8, wherein said air-cooled absorber and said air-cooled condenser are disposed at an angle relative to each other and are exposed to separate air streams from said air inlet to said air outlet.

* * * * *